US007921925B2

(12) United States Patent
Maguire et al.

(10) Patent No.: US 7,921,925 B2
(45) **Date of Patent: *Apr. 12, 2011**

(54) METHOD AND APPARATUS FOR EXPANDING AND SEPARATING TUBULARS IN A WELLBORE

(75) Inventors: Patrick G. Maguire, Cypress, TX (US); Robert J. Coon, Missouri City, TX (US); Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 123 days.

This patent is subject to a terminal disclaimer.

(21) Appl. No.: 12/119,216

(22) Filed: May 12, 2008

(65) Prior Publication Data

US 2008/0202753 A1 Aug. 28, 2008

Related U.S. Application Data

(60) Division of application No. 10/863,825, filed on Jun. 8, 2004, now Pat. No. 7,373,990, which is a continuation-in-part of application No. 09/969,089, filed on Oct. 2, 2001, now Pat. No. 6,752,215, which is a continuation-in-part of application No. 09/469,690, filed on Dec. 22, 1999, now Pat. No. 6,457,532.

(51) Int. Cl.
*E21B 19/16* (2006.01)

(52) U.S. Cl. ..... 166/384; 166/207

(58) Field of Classification Search ..... 166/384, 166/207

See application file for complete search history.

(56) References Cited

U.S. PATENT DOCUMENTS

| | | | |
|---|---|---|---|
| 761,518 | A | 5/1904 | Lykken |
| 958,517 | A | 5/1910 | Mettler |
| 1,324,303 | A | 12/1919 | Carmichael |
| 1,545,039 | A | 7/1925 | Deavers |
| 1,561,418 | A | 11/1925 | Duda |
| 1,569,729 | A | 1/1926 | Duda |
| 1,597,212 | A | 8/1926 | Spengler |
| 1,930,825 | A | 10/1933 | Raymond |

(Continued)

FOREIGN PATENT DOCUMENTS

EP 0 961 007 12/1999

(Continued)

OTHER PUBLICATIONS

GB Search Report for Application No. GB0519435.2 dated Oct. 19, 2005.

(Continued)

*Primary Examiner* — William P Neuder

(74) *Attorney, Agent, or Firm* — Patterson & Sheridan, LLP

(57) ABSTRACT

Embodiments of the present invention provide an apparatus and method for expanding a tubular. In one aspect, embodiments of the prevent invention provide an expander tool having at least two expansion members radially extendable from the expander tool into contact with a surrounding inside surface of the tubular, the at least two expansion members radially extendable at different times and axially spaced after radially extending. In another aspect, embodiments include a method for isolating a first portion of a wellbore from a second portion of a wellbore comprising locating an expandable tubular within the wellbore between the first and second portions, the expandable tubular having a weakened portion therein, isolating the first portion from the second portion of the wellbore, and expanding the expandable tubular proximate to the weakened portion to sever the expandable tubular.

40 Claims, 22 Drawing Sheets

U.S. PATENT DOCUMENTS

| | | | | |
|---|---|---|---|---|
| 1,981,525 | A | 11/1934 | Price | |
| 2,175,372 | A | 10/1939 | Allen | |
| 2,214,226 | A | 9/1940 | English | |
| 2,383,214 | A | 8/1945 | Prout | |
| 2,499,630 | A | 3/1950 | Clark | |
| 2,627,891 | A | 2/1953 | Clark | |
| 2,754,577 | A | 7/1956 | Maxwell | |
| 2,898,971 | A | 8/1959 | Hempel | |
| 3,087,546 | A | 4/1963 | Woolley | |
| 3,191,677 | A | 6/1965 | Kinley | |
| 3,191,680 | A | 6/1965 | Vincent | |
| 3,195,646 | A | 7/1965 | Brown | |
| 3,712,376 | A | 1/1973 | Owen et al. | |
| 3,776,307 | A | 12/1973 | Young | |
| 3,818,734 | A | 6/1974 | Bateman | |
| 3,911,707 | A | 10/1975 | Minakov et al. | |
| 3,948,321 | A | 4/1976 | Owen et al. | |
| 4,069,573 | A | 1/1978 | Rogers, Jr. et al. | |
| 4,127,168 | A | 11/1978 | Hanson et al. | |
| 4,159,564 | A | 7/1979 | Cooper, Jr. | |
| 4,288,082 | A | 9/1981 | Setterberg, Jr. | |
| 4,319,393 | A | 3/1982 | Pogonowski | |
| 4,324,407 | A | 4/1982 | Upham et al. | |
| 4,371,199 | A | 2/1983 | Kushner et al. | |
| 4,429,620 | A | 2/1984 | Burkhardt et al. | |
| 4,502,308 | A | 3/1985 | Kelly | |
| 4,531,581 | A | 7/1985 | Pringle et al. | |
| 4,538,442 | A | 9/1985 | Reed | |
| 4,588,030 | A | 5/1986 | Blizzard | |
| 4,697,640 | A | 10/1987 | Szarka | |
| 4,848,469 | A | 7/1989 | Baugh et al. | |
| 5,052,483 | A | 10/1991 | Hudson | |
| 5,348,095 | A | 9/1994 | Worrall et al. | |
| 5,409,059 | A | 4/1995 | McHardy | |
| 5,472,057 | A | 12/1995 | Winfree | |
| 5,560,426 | A | 10/1996 | Trahan et al. | |
| 5,685,369 | A | 11/1997 | Ellis et al. | |
| 6,012,523 | A | 1/2000 | Campbell et al. | |
| 6,021,850 | A | 2/2000 | Wood et al. | |
| 6,029,748 | A | 2/2000 | Forsyth et al. | |
| 6,053,247 | A | 4/2000 | Wesson et al. | |
| 6,098,717 | A | 8/2000 | Bailey et al. | |
| 6,325,148 | B1 | 12/2001 | Trahan et al. | |
| 6,425,444 | B1 | 7/2002 | Metcalfe et al. | |
| 6,446,323 | B1 | 9/2002 | Metcalfe et al. | |
| 6,446,724 | B2 | 9/2002 | Baugh et al. | |
| 6,457,532 | B1 | 10/2002 | Simpson | |
| 6,527,049 | B2 | 3/2003 | Metcalfe et al. | |
| 6,543,552 | B1 | 4/2003 | Metcalfe et al. | |
| 6,578,630 | B2 | 6/2003 | Simpson et al. | |
| 6,585,053 | B2 | 7/2003 | Coon | |
| 6,598,678 | B1 | 7/2003 | Simpson et al. | |
| 6,702,029 | B2 | 3/2004 | Metcalfe et al. | |
| 6,702,030 | B2 | 3/2004 | Simpson | |
| 6,708,769 | B2 | 3/2004 | Haugen et al. | |
| 6,745,846 | B1 | 6/2004 | Innes et al. | |
| 6,752,215 | B2 * | 6/2004 | Maguire et al. | 166/380 |
| 6,752,216 | B2 | 6/2004 | Coon | |
| 6,976,536 | B2 * | 12/2005 | Simpson et al. | 166/277 |
| 7,104,323 | B2 | 9/2006 | Cook et al. | |
| 2001/0045284 | A1 | 11/2001 | Simpson et al. | |
| 2002/0104647 | A1 * | 8/2002 | Lawrence | 166/55.1 |
| 2003/0042028 | A1 | 3/2003 | Lauritzen et al. | |
| 2003/0121655 | A1 | 7/2003 | Lauritzen et al. | |
| 2006/0052936 | A1 | 3/2006 | Duggan et al. | |

FOREIGN PATENT DOCUMENTS

| | | |
|---|---|---|
| GB | 1 448 304 | 9/1976 |
| GB | 1 457 843 | 12/1976 |
| GB | 2 216 926 | 10/1989 |
| GB | 2 313 860 | 12/1997 |
| GB | 2 320 734 | 7/1998 |
| GB | 2 329 918 | 4/1999 |
| GB | 2 345 308 | 7/2000 |
| GB | 2 392 189 | 2/2004 |
| WO | WO 93/24728 | 12/1993 |
| WO | WO 99/18328 | 4/1999 |
| WO | WO 99/23354 | 5/1999 |
| WO | WO 00/37772 | 6/2000 |
| WO | WO 03/021080 | 3/2003 |
| WO | WO 03/048520 | 6/2003 |

OTHER PUBLICATIONS

GB Search Report for Application No. GB0511598.5 dated Aug. 10, 2005.

PCT International Search Report for Application No. PCT/GB 02/04368 dated Jan. 3, 2003.

PCT International Preliminary Examination Report for International Application No. PCT/GB99/04365 dated Mar. 23, 2001.

PCT International Search Report for International Application No. PCT/GB 00/04160 dated Apr. 18, 2001.

GB Search Report for Application No. GB 9930398.4 dated Jun. 27, 2000.

GB Search Report for Application No. GB 9930166.5 dated Jun. 12, 2000.

PCT International Search Report for International Application No. PCT/GB 99/04246 dated Mar. 3, 2000.

PCT International Search Report for International Application No. PCT/GB 99/04365 dated Mar. 3, 2000.

* cited by examiner

Fig. 15A
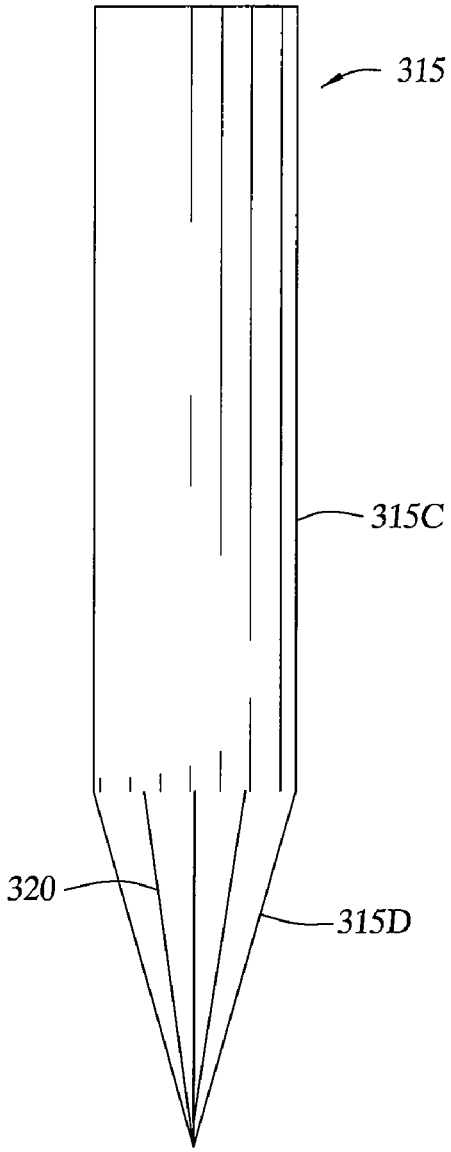
Fig. 15C
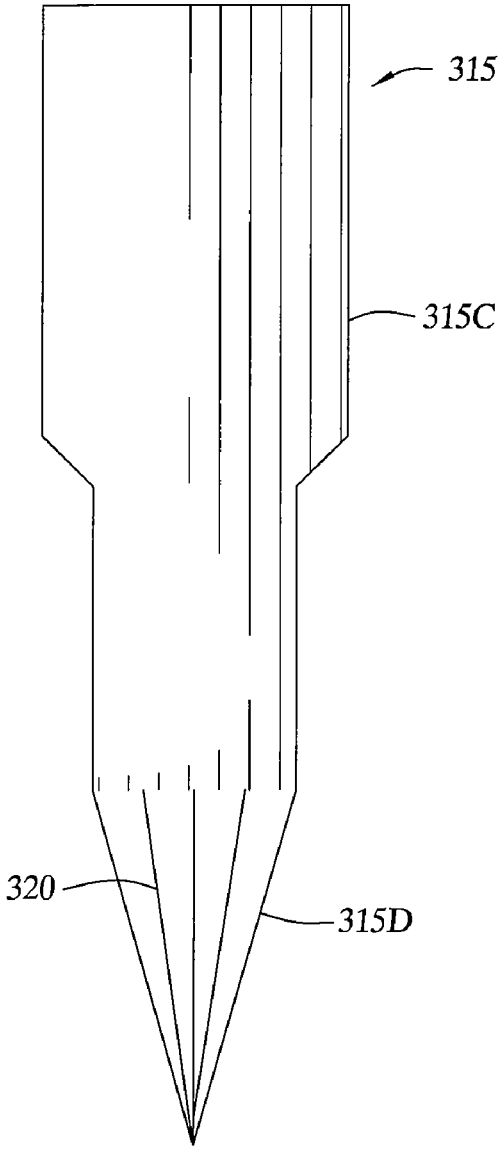
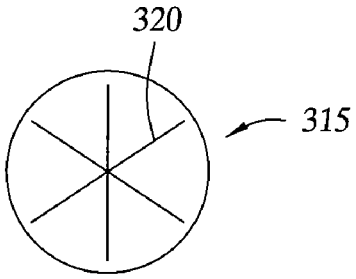
Fig. 15B

Fig. 15D
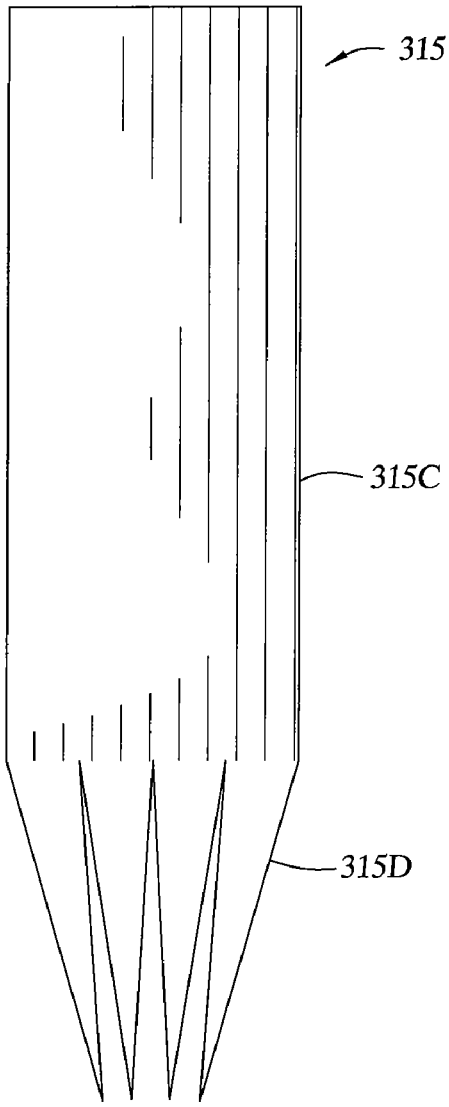
Fig. 15F
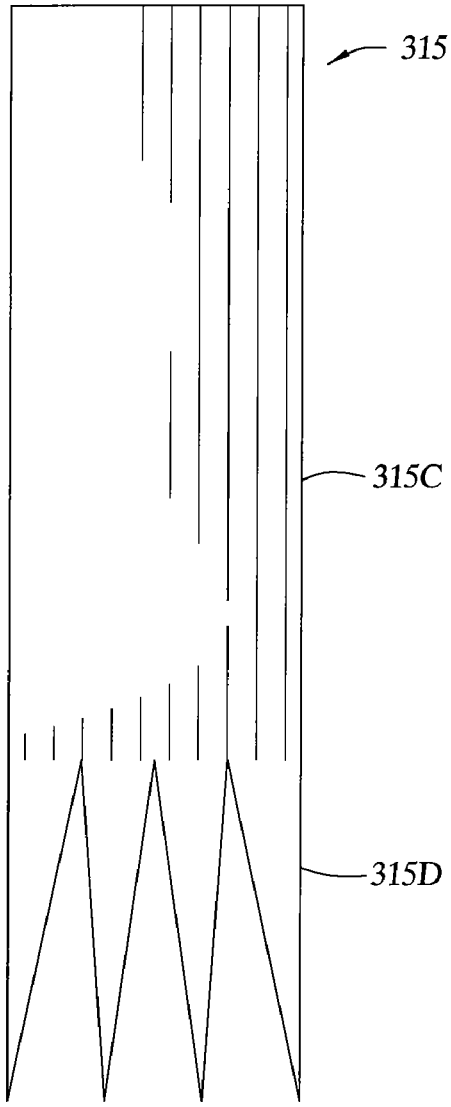
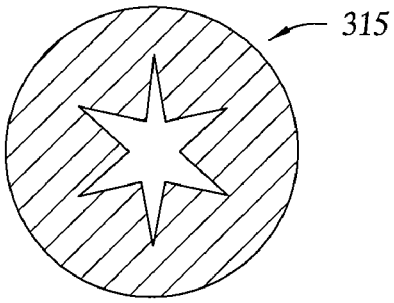
Fig. 15E
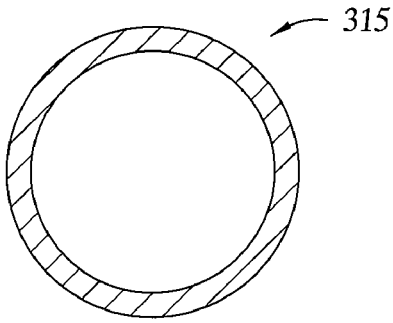
Fig. 15G

METHOD AND APPARATUS FOR EXPANDING AND SEPARATING TUBULARS IN A WELLBORE

CROSS-REFERENCE TO RELATED APPLICATIONS

This application is a divisional of a U.S. patent application Ser. No. 10/863,825, filed on Jun. 8, 2004 now U.S. Pat. No. 7,373,990; which is a continuation-in-part of U.S. patent application Ser. No. 09/969,089 filed Oct. 2, 2001 now U.S. Pat. No. 6,752,215, which are herein incorporated by reference in their entirety. U.S. patent application Ser. No. 09/969,089 is a continuation-in-part of U.S. patent application Ser. No. 09/469,690 filed Dec. 22, 1999, now U.S. Pat. No. 6,457,532, which is herein incorporated by reference in its entirety.

BACKGROUND OF THE INVENTION

1. Field of the Invention

The present invention relates to methods and apparatus for wellbore completions. More particularly, the invention relates to completing a wellbore by expanding tubulars therein. More particularly still, the invention relates to completing a wellbore by separating an upper portion of a tubular from a lower portion of the tubular.

2. Description of the Related Art

Hydrocarbon and other wells are completed by forming a borehole in the earth and then lining the borehole with steel pipe or casing to form a wellbore. After a section of wellbore is formed by drilling, a section of casing is lowered into the wellbore and temporarily hung therein from the surface of the well. Using apparatus known in the art, the casing is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung off" of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever decreasing diameter.

Apparatus and methods are emerging that permit tubulars to be expanded in situ. The apparatus typically includes expander tools which are fluid powered and are run into a wellbore on a working string. The hydraulic expander tools include radially expandable members which, through fluid pressure, are urged outward radially from the body of the expander tool and into contact with a tubular therearound. As sufficient pressure is generated on a piston surface behind these expansion members, the tubular being acted upon by the expansion tool is expanded past its point of plastic deformation. In this manner, the inner and outer diameter of the tubular is increased in the wellbore. By rotating the expander tool in the wellbore and/or moving the expander tool axially in the wellbore with the expansion member actuated, a tubular can be expanded along a predetermined length in a wellbore.

There are advantages to expanding a tubular within a wellbore. For example, expanding a first tubular into contact with a second tubular therearound eliminates the need for a conventional slip assembly. With the elimination of the slip assembly, the annular space required to house the slip assembly between the two tubulars can be reduced.

In one example of utilizing an expansion tool and expansion technology, a liner can be hung off of an existing string of casing without the use of a conventional slip assembly. A new section of liner is run into the wellbore using a run-in string. As the assembly reaches that depth in the wellbore where the liner is to be hung, the new liner is cemented in place. Before the cement sets, an expander tool is actuated and the liner is expanded into contact with the existing casing therearound. By rotating the expander tool in place, the new lower string of casing can be fixed onto the previous upper string of casing, and the annular area between the two tubulars is sealed.

There are problems associated with the installation of a second string of casing in a wellbore using an expander tool. Because the weight of the casing must be borne by the run-in string during cementing and expansion, there is necessarily a portion of surplus casing remaining above the expanded portion. In order to properly complete the well, that section of surplus unexpanded casing must be removed in order to provide a clear path through the wellbore in the area of transition between the first and second casing strings.

Known methods for severing a string of casing in a wellbore present various drawbacks. For example, a severing tool may be run into the wellbore that includes cutters which extend into contact with the tubular to be severed. The cutters typically pivot away from a body of the cutter. Thereafter, through rotation the cutters eventually sever the tubular. This approach requires a separate trip into the wellbore, and the severing tool can become binded and otherwise malfunction. The severing tool can also interfere with the upper string of casing. Another approach to severing a tubular in a wellbore includes either explosives or chemicals. These approaches likewise require a separate trip into the wellbore, and involve the expense and inconvenience of transporting and using additional chemicals during well completion. These methods also create a risk of interfering with the upper string of casing. Another possible approach is to use a separate fluid powered tool, like an expansion tool wherein one of the expansion members is equipped with some type of rotary cutter. This approach, however, requires yet another specialized tool and manipulation of the run-in string in the wellbore in order to place the cutting tool adjacent that part of the tubular to be severed. The approach presents the technical problem of operating two expansion tools selectively with a single tubular string.

Similar problems with current methods and apparatus for severing a tubular in a wellbore exist regardless of whether the tubular is casing, where the tubular is hung from the casing of a cased wellbore or from the wellbore wall of an open hole wellbore. The tubular or portions of the tubular must often be removed when the tubular becomes corroded or when the tubular is no longer needed within the wellbore (e.g., because a different type of tubular is needed in the wellbore to perform a different function than previously performed). As mentioned above, the current method of running in a severing tool to sever the tubular requires a separate trip into the wellbore, and the severing tool can malfunction. Explosives or chemicals also require a separate trip into the wellbore and are expensive to transport and use, as stated above. Additionally, the casing of the cased wellbore may be damaged by the running in or the functioning of the severing tool, explosives, or chemicals used to sever the tubular.

Temporary plugs are often used within the wellbore to isolate one portion of the wellbore from the remaining portion of the wellbore. Typically, the plug must be set within the wellbore initially, and then the wellbore operation is performed within one of the portions of the wellbore. When it is desired to remove the plug and thus allow unobstructed access to both portions of the wellbore, the plug must be severed and retrieved from the wellbore. Releasing and/or retrieving the plug is often difficult because of debris falling onto the plug during the preceding wellbore operation. There is a need for a temporary plug which does not require retrieval from the wellbore upon completion of the plug's function within the wellbore. There is a further need for a plug which is capable of being released and/or opened in spite of the presence of debris.

There is a need, therefore, for an improved apparatus and method for severing an upper portion of a tubular after the tubular has been set in a wellbore by expansion means. There is a further need for an improved method and apparatus for severing a tubular in a wellbore. There is yet a further need for a method and apparatus to quickly and simply sever a tubular in a wellbore without a separate trip into the wellbore and without endangering the integrity of the casing within the wellbore.

SUMMARY OF THE INVENTION

Embodiments of the present invention provide methods and apparatus for completing a wellbore. According to the present invention, an expansion assembly is run into a wellbore on a run-in string. The expansion assembly comprises a lower string of casing to be hung in the wellbore, and an expander tool disposed at an upper end thereof. The expander tool preferably includes a plurality of expansion members which are radially disposed around a body of the tool in a spiraling arrangement. In addition, the lower string of casing includes a scribe placed in the lower string of casing at the point of desired severance. The scribe creates a point of structural weakness within the wall of the casing so that it fails upon expansion.

The expander tool is run into the wellbore to a predetermined depth where the lower string of casing is to be hung. In this respect, a top portion of the lower string of casing, including the scribe, is positioned to overlap a bottom portion of an upper string of casing already set in the wellbore. In this manner, the scribe in the lower string of casing is positioned downhole at the depth where the two strings of casing overlap. Cement is injected through the run-in string and circulated into the annular area between the lower string of casing and the formation. Cement is further circulated into the annulus where the lower and upper strings of casing overlap. Before the cement cures, the expansion members at a lower portion of the expansion tool are actuated so as to expand the lower string of casing into the existing upper string at a point below the scribe. As the uppermost expansion members extend radially outward into contact with the casing, including those at the depth of the scribe, the scribe causes the casing to be severed. Thereafter, with the lower string of casing expanded into frictional and sealing relationship with the existing upper casing string, the expansion tool and run-in string, are pulled from the wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 7 further depicts the lower string of casing having been severed into an upper portion and a lower portion due to expansion.

FIGS. 15A-J illustrate steps in a second embodiment of a plug installation and release operation.

DETAILED DESCRIPTION OF THE PREFERRED EMBODIMENT

Figure 1:
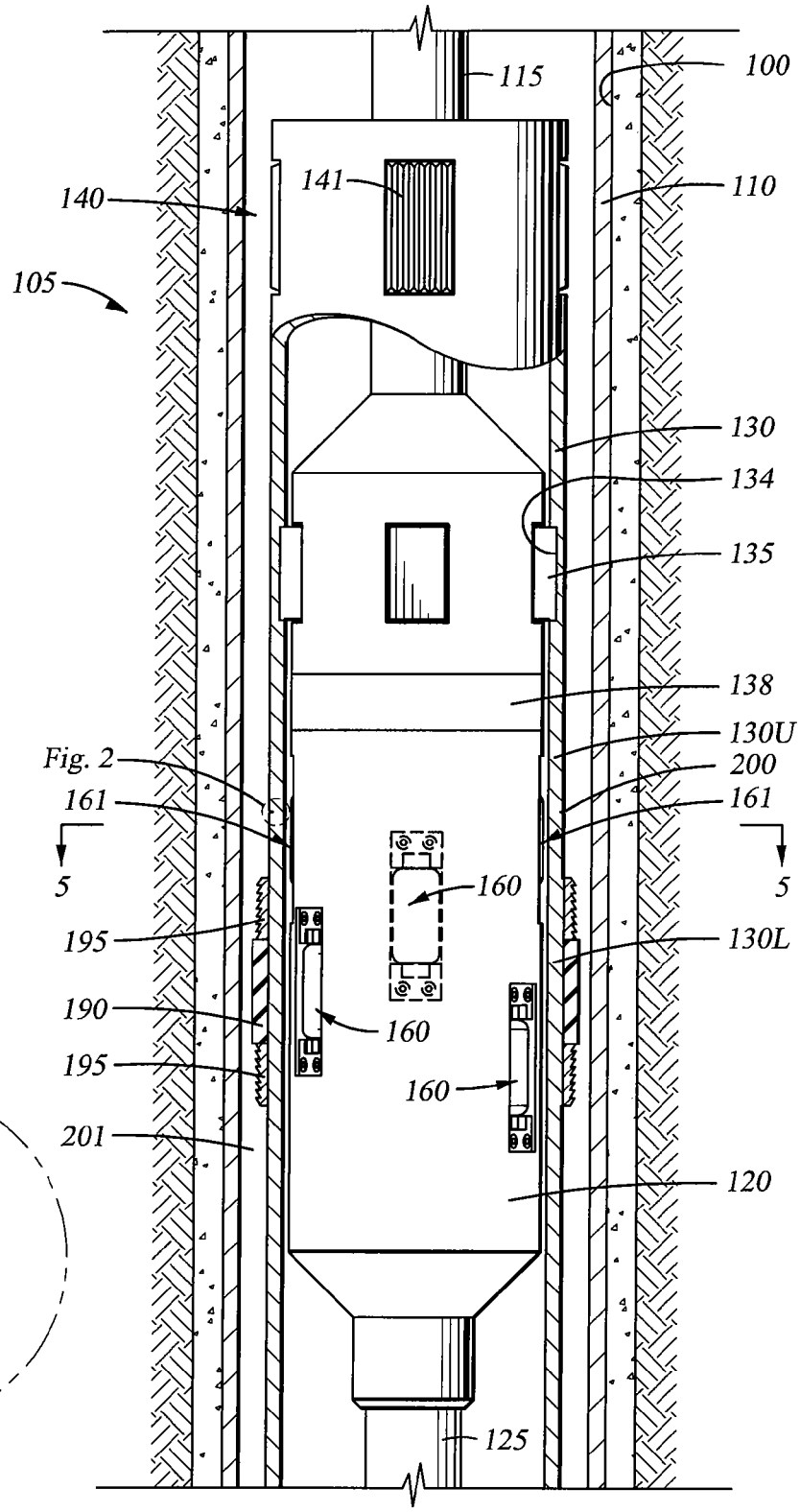
FIG. 1 is a partial section view of a wellbore illustrating the assembly of the present invention in a run-in position.

FIG. 1 is a section view of a wellbore 100 illustrating an apparatus 105 for use in the methods of the present invention. The apparatus 105 essentially defines a string of casing 130, and an expander tool 120 for expanding the string of casing 130. By actuation of the expander tool 120 against the inner surface of the string of casing 130, the string of casing 130 is expanded into a second, upper string of casing 110 which has already been set in the wellbore 100. In this manner, the top portion of the lower string of casing 130U is placed in frictional engagement with the bottom portion of the upper string of casing 110.

Figure 2:
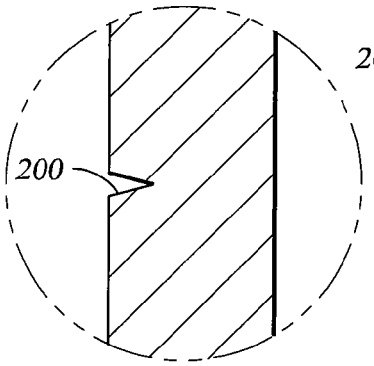
FIG. 2 is an enlarged sectional view of a wall in the lower string of casing more fully showing one embodiment of a scribe of the present invention.

In accordance with the present invention, a scribe 200 is placed into the surface of the lower string of casing 130. An enlarged view of the scribe 200 in one embodiment is shown in FIG. 2. As will be disclosed in greater detail, the scribe 200 creates an area of structural weakness within the lower casing string 130. When the lower string of casing 130 is expanded at the depth of the scribe 200, the lower string of casing 130 is severed into upper 130U and lower 130L portions. The upper portion 130U of the lower casing string 130 can then be easily removed from the wellbore 100. Thus, the scribe may serve as a release mechanism for the lower casing string 130.

At the stage of completion shown in FIG. 1, the wellbore 100 has been lined with the upper string of casing 110. A working string 115 is also shown in FIG. 1. Attached to a lower end of the run-in string 115 is an expander tool 120. Also attached to the working string 115 is the lower string of casing 130. In the embodiment of FIG. 1, the lower string of casing 130 is supported during run-in by a series of dogs 135 disposed radially about the expander tool 120. The dogs 135 are landed in a circumferential profile 134 within the upper string of casing 130.

A sealing ring 190 is disposed on the outer surface of the lower string of casing 130. In the preferred embodiment, the sealing ring 190 is an elastomeric member circumferentially fitted onto the outer surface of the casing 130. However, non-elastomeric materials may also be used. The sealing ring 190 is designed to seal an annular area 201 formed between the outer surface of the lower string of casing 130 and the inner surface of the upper string of casing 110 upon expansion of the lower string 130 into the upper string 110.

Also positioned on the outer surface of the lower string of casing 130 is at least one slip member 195. In the preferred embodiment of the apparatus 105, the slip member 195 defines a pair of rings having grip surfaces formed thereon for engaging the inner surface of the upper string of casing 110 when the lower string of casing 130 is expanded. In the embodiment shown in FIG. 1, one slip ring 195 is disposed above the sealing ring 190, and one slip ring 195 is disposed below the sealing ring 190. In FIG. 1, the grip surface includes teeth formed on each slip ring 195. However, the slips could be of any shape and the grip surfaces could include any number of geometric shapes, including button-like inserts (not shown) made of high carbon material.

Fluid is circulated from the surface and into the wellbore 100 through the working string 115. A bore 168, shown in FIG. 3, runs through the expander tool 120, placing the working string 115 and the expander tool 120 in fluid communication. A fluid outlet 125 is provided at the lower end of the expander tool 120. In the preferred embodiment, shown in FIG. 1, a tubular member serves as the fluid outlet 125. The fluid outlet 125 serves as a fluid conduit for cement to be circulated into the wellbore 100 in accordance with the method of the present invention.

In the embodiment shown in FIG. 1, the expander tool 120 includes a swivel 138. The swivel 138 allows the expander tool 120 to be rotated by the working tubular 115 while the supporting dogs 135 remain stationary.

Figures 3, 4:
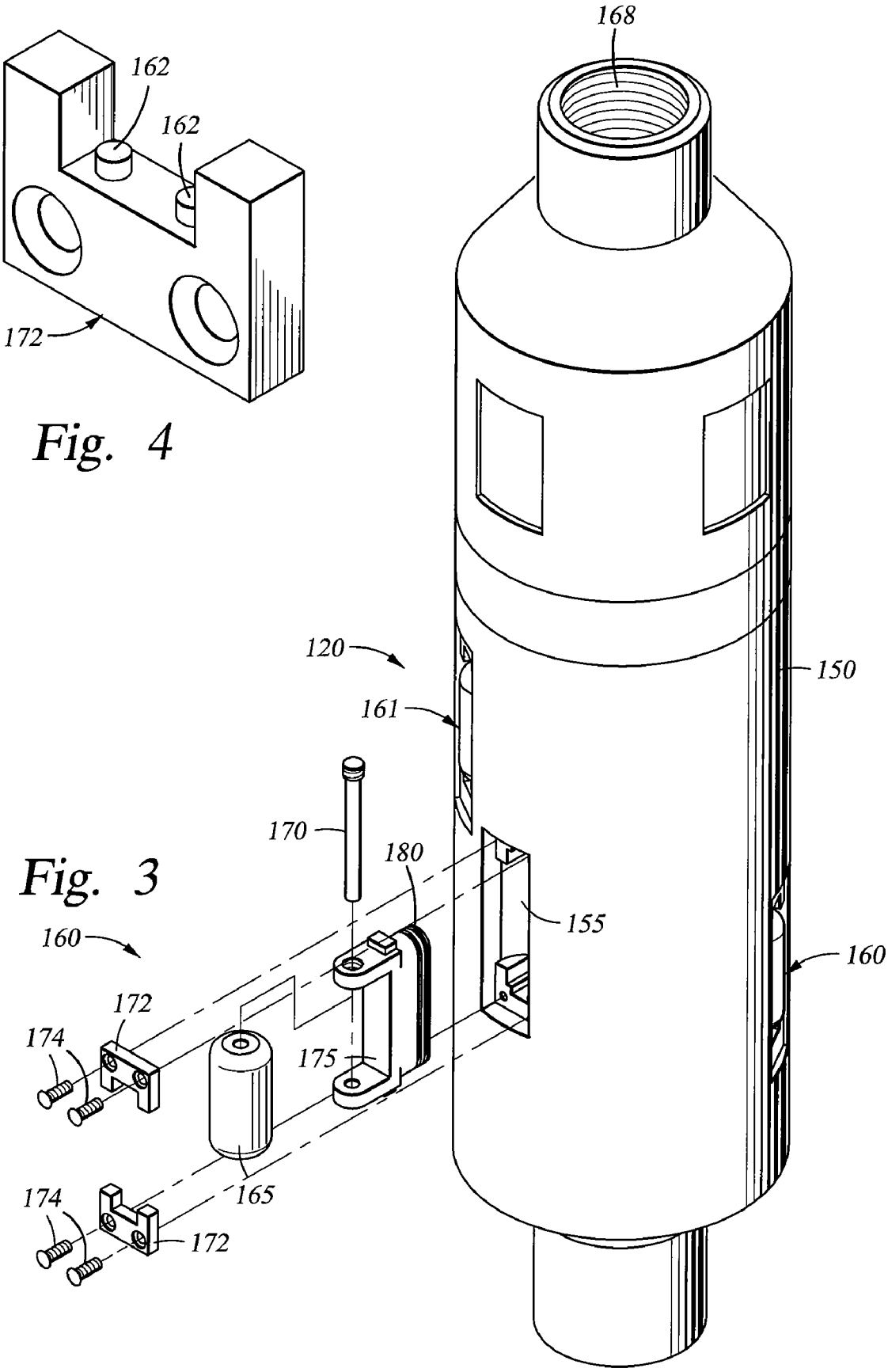
FIG. 3 is an exploded view of an expander tool as might be used in the methods of the present invention.
FIG. 4 is a perspective view showing a shearable connection for an expansion member.

FIG. 3 is an exploded view of the expander tool 120 itself. The expander tool 120 consists of a cylindrical body 150 having a plurality of windows 155 formed therearound. Within each window 155 is an expansion assembly 160 which includes a roller 165 disposed on an axle 170 which is supported at each end by a piston 175. The piston 175 is retained in the body 150 by a pair of retention members 172 that are held in place by screws 174. The assembly 160 includes a piston surface 180 formed opposite the piston 175 which is acted upon by pressurized fluid in the bore 168 of the expander tool 120. The pressurized fluid causes the expansion assembly 160 to extend radially outward and into contact with the inner surface of the lower string of casing 130. With a predetermined amount of fluid pressure acting on the piston surface 180 of piston 175, the lower string of casing 130 is expanded past its elastic limits.

The expander tool 120 illustrated in FIGS. 1 and 3 includes expansion assemblies 160 that are disposed around the perimeter of the expander tool body 150 in a spiraling fashion. Located at an upper position on the expander tool 120 are two opposed expansion assemblies 160 located 180° apart. The expander tool 120 is constructed and arranged whereby the uppermost expansion members 161 are actuated after the other assemblies 160.

In one embodiment, the uppermost expansion members 161 are retained in their retracted position by at least one shear pin 162 which fails with the application of a predetermined radial force. In FIG. 4 the shearable connection is illustrated as two pin members 162 extending from a retention member 172 to a piston 175. When a predetermined force is applied between the pistons 175 of the uppermost expansion members 161 and the retaining pins 162, the pins 162 fail and the piston 175 moves radially outward. In this manner, actuation of the uppermost members 161 can be delayed until all of the lower expansion assemblies 160 have already been actuated.

Figure 5A:
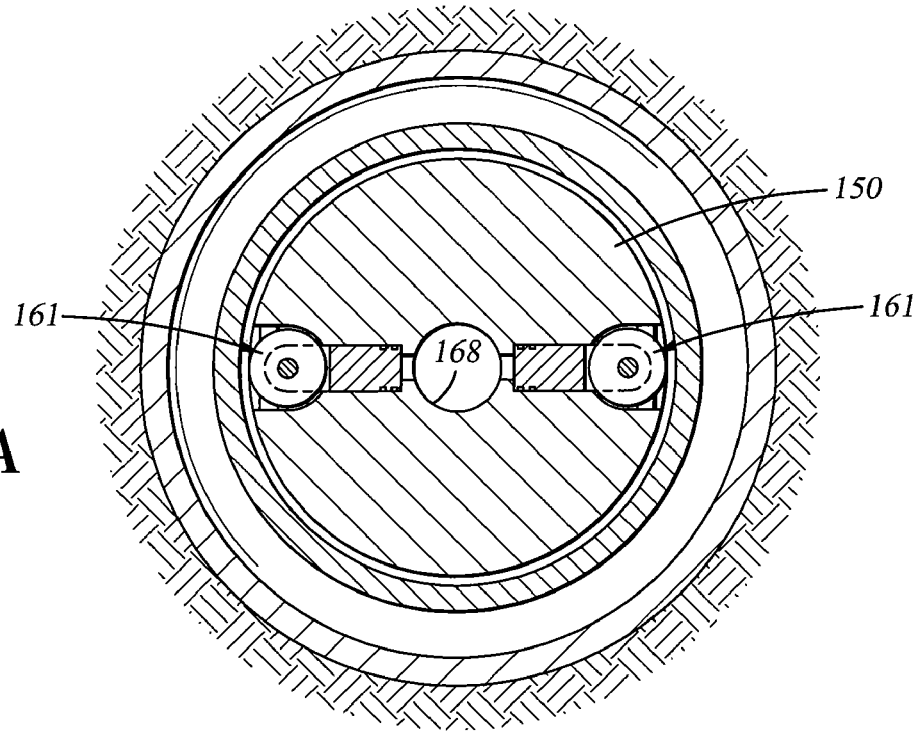
FIGS. 5A-5D are section views taken along a line 5-5 of FIG. 1 and illustrating the position of expansion members during progressive operation of the expansion tool.
Figure 5B:
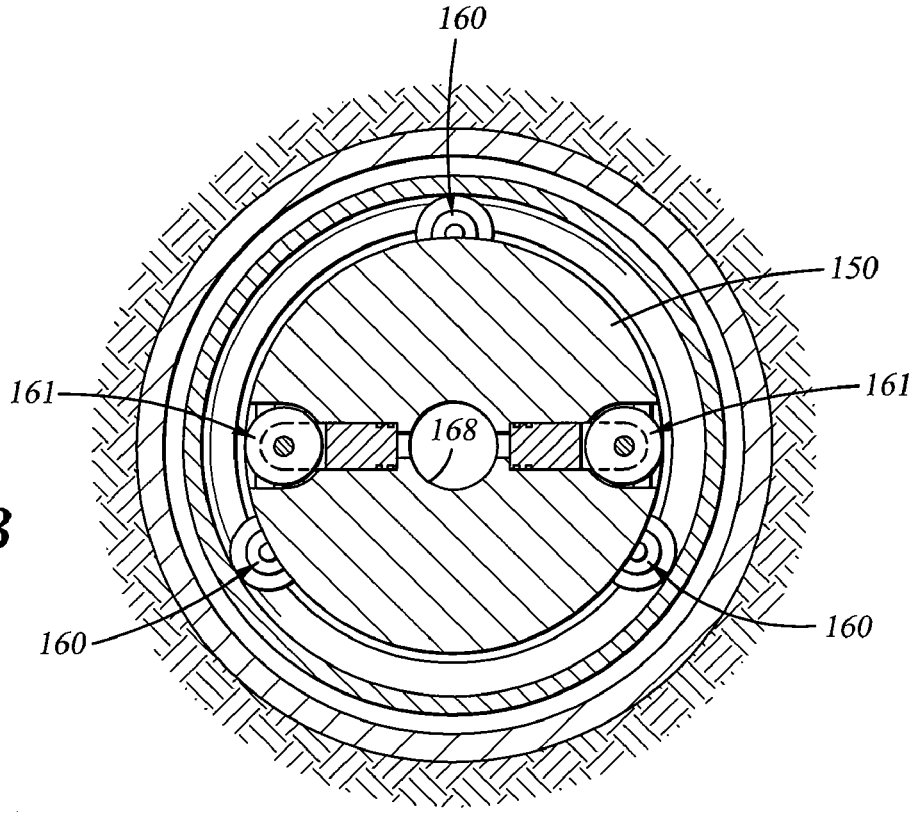

FIGS. 5A-5D are section views of the expander tool 120 taken along lines 5-5 of FIG. 1. The purpose of FIGS. 5A-5D is to illustrate the relative position of the various expansion assemblies 160 and 161 during operation of the expander tool 120 in a wellbore 100. FIG. 5A illustrates the expander tool 120 in the run-in position with all of the radially outward extending expansion assemblies 160, 161 in a retracted position within the body 150 of the expander tool 120. In this position, the expander tool 120 can be run into a wellbore 100 without creating a profile any larger than the outside diameter of the expansion tool body 150. FIG. 5B illustrates the expander tool 120 with all but the upper-most expansion assemblies 160 and 161 actuated. Because the expansion assemblies 160 are spirally disposed around the body 150 at different depths, in FIG. 5B the expander tool 120 would have expanded a portion of the lower string of casing 130 axially as well as radially. In addition to the expansion of the lower string of casing 130 due to the location of the expansion assemblies 160, the expander tool 120 and working string 115 can be rotated relative to the lower string of casing 130 to form a circumferential area of expanded liner 130L. Rotation is possible due to a swivel 138 located above the expander tool 120 which permits rotation of the expander tool 120 while ensuring the weight of the casing 130 is borne by the dogs 135.

Figure 6:
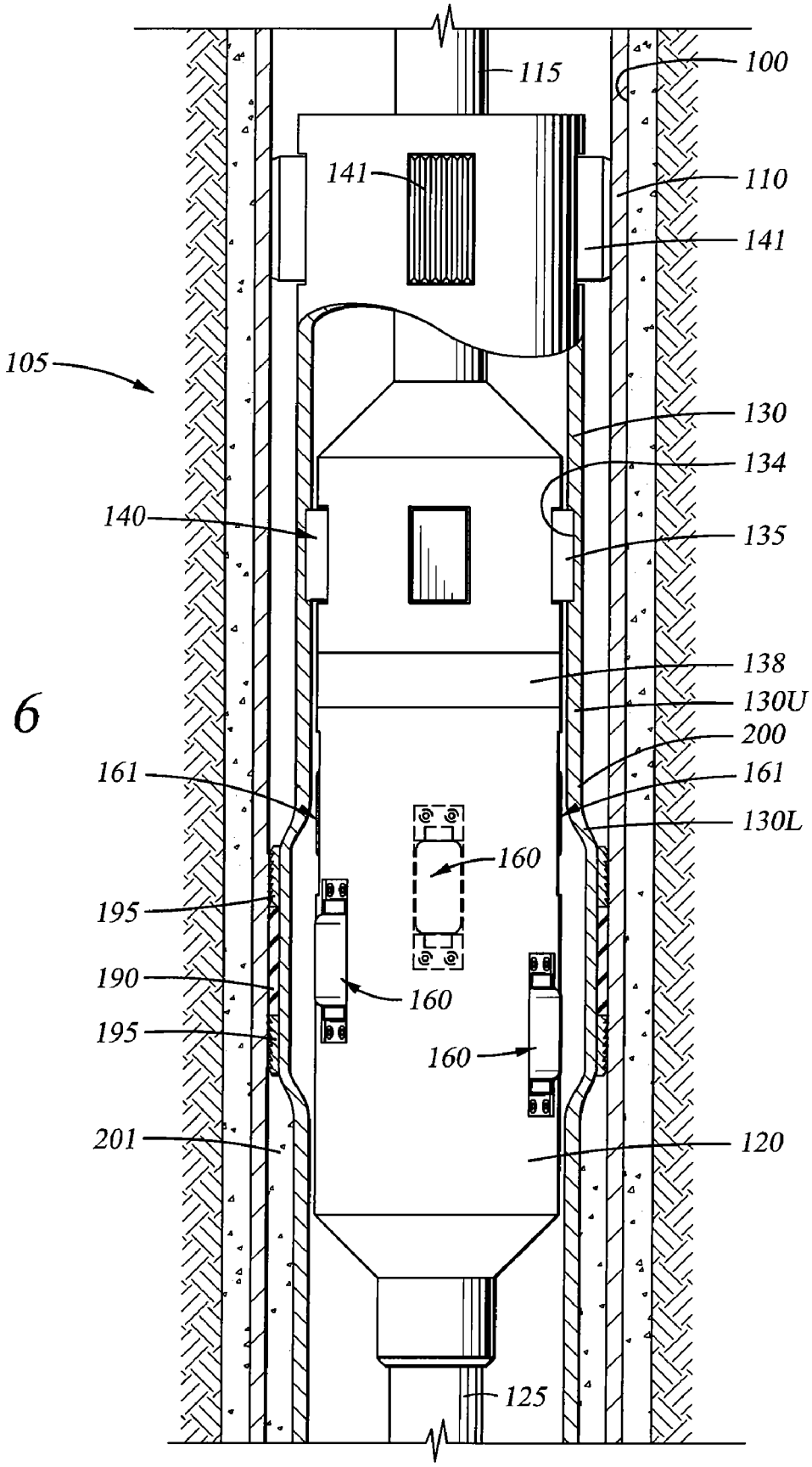
FIG. 6 is a partial section view of the apparatus in a wellbore illustrating a portion of the lower string of casing, including slip and sealing members, having been expanded into the upper string of casing therearound.

FIG. 6 presents a partial section view of the apparatus 105 after expanding a portion of the lower string of casing 130L into the upper string of casing 110. Expansion assemblies 160 have been actuated in order to act against the inner surface of the lower string of casing 130L. Thus, FIG. 6 corresponds to FIG. 5B. Visible also in FIG. 6 is sealing ring 190 in contact with the inside wall of the casing 110. Slips 195 are also in contact with the upper string of casing 110.

Figure 5C:
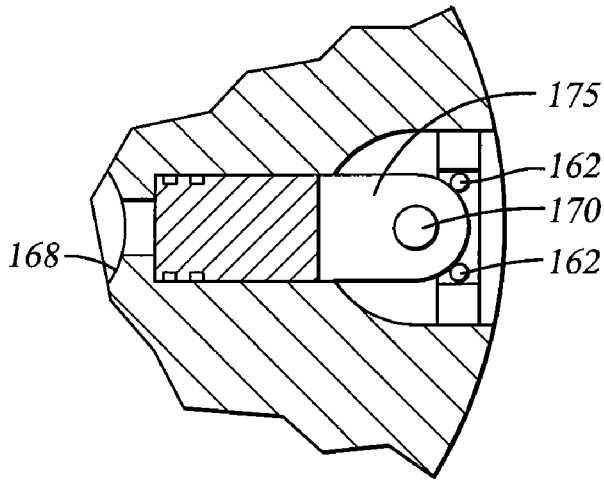

FIG. 5C is a top section view of a top expansion member 160 in its recessed state. Present in this view is a piston 175 residing within the body 150 of the expander tool 120. Also present is the shearable connection, i.e., shear pins 162 of FIG. 4.

Figure 5D:
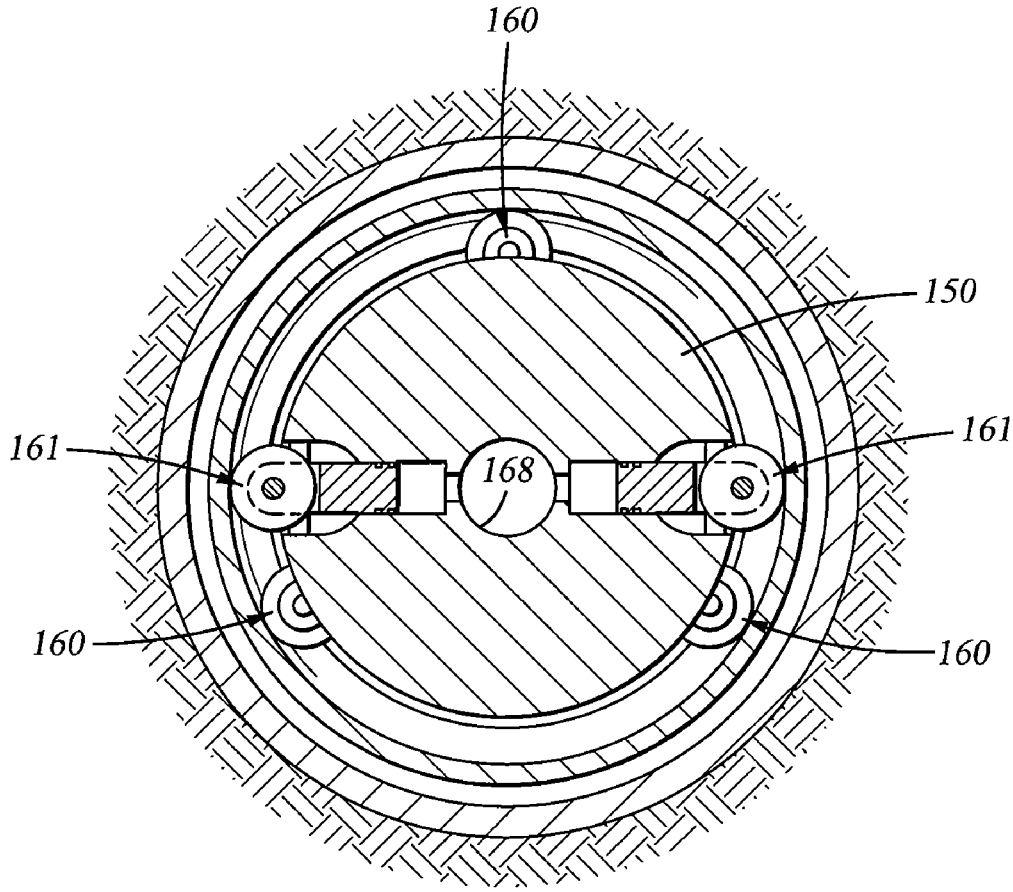

Referring to FIG. 5D, this figure illustrates the expander tool 120 with all of the expansion assemblies 160 and 161 actuated, including the uppermost expansion members 161. As previously stated, the uppermost expansion members 161 are constructed and arranged to become actuated only after the lower assemblies 160 have been actuated.

Figure 7:
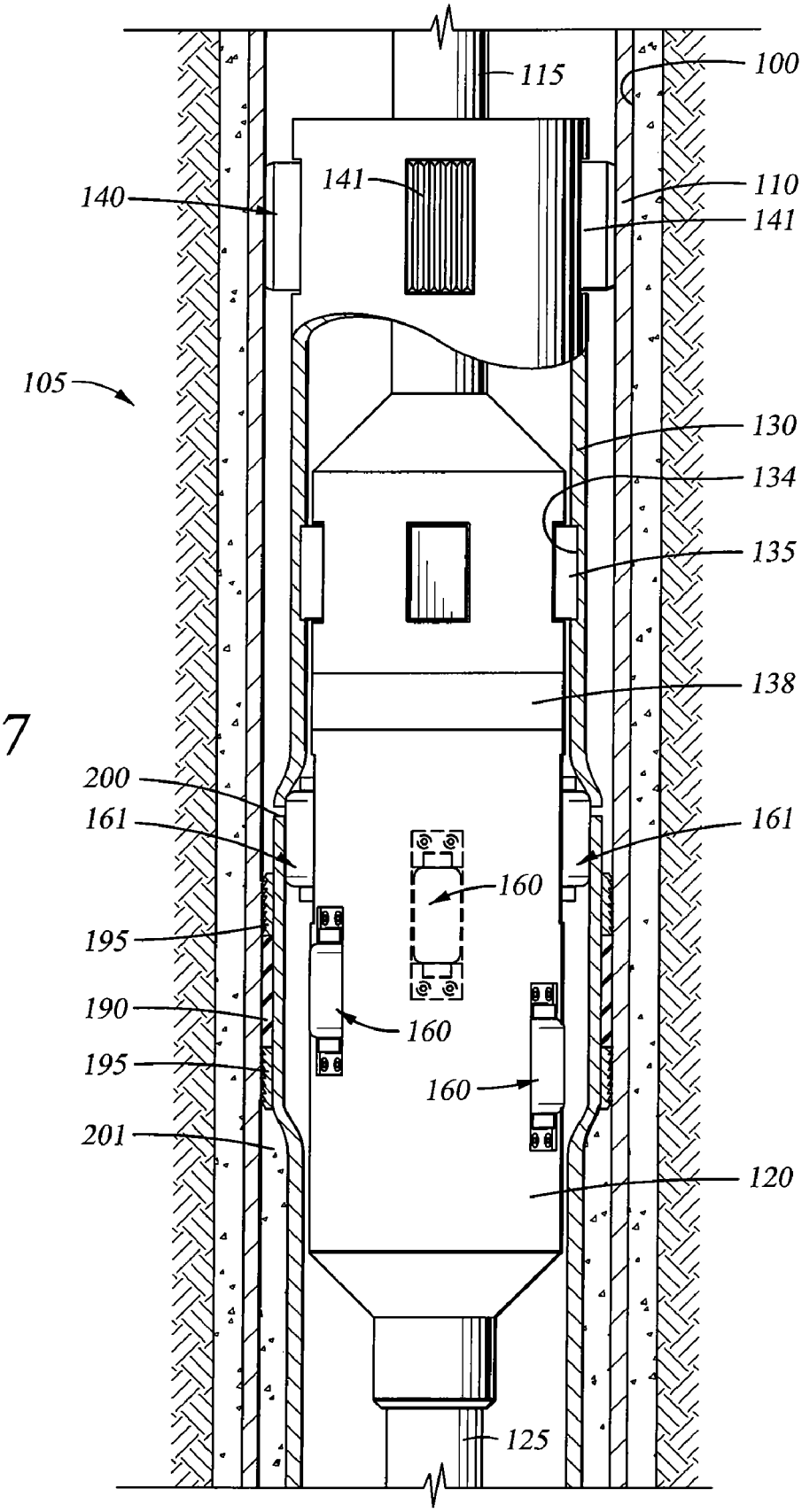
FIG. 7 is a partial section view of the apparatus illustrating the lower string of casing expanded into frictional and sealing engagement with the upper string of casing.

FIG. 7 depicts a wellbore 100 having an expander tool 120 and lower string of casing 130 of the present invention disposed therein. In this view, all of the expansion assemblies 160, 161, including the uppermost expansion members 161, have been actuated. Thus, FIG. 7 corresponds to the step presented in FIG. 5D.

Referring again to FIG. 1, formed on the surface of the lower string of casing 130L adjacent the uppermost expansion member 161 is a scribe 200. The scribe 200 creates an area of structural weakness within the lower casing string 130. When the lower string of casing 130 is expanded at the depth of the scribe 200, the lower string of casing 130 breaks cleanly into upper 130U and lower 130L portions. The upper portion 130U of the lower casing string 130 can then be easily removed from the wellbore 100.

The inventors have determined that a scribe 200 in the wall of a string of casing 130 or other tubular will allow the casing 130 to break cleanly when radial outward pressure is placed at the point of the scribe 200. The depth of the cut 200 needed to cause the break is dependent upon a variety of factors, including the tensile strength of the tubular, the overall deflection of the material as it is expanded, the profile of the cut, and the weight of the tubular being hung. Thus, the scope of the present invention is not limited by the depth of the particular cut or cuts 200 being applied, so long as the scribe 200 is shallow enough that the tensile strength of the tubular 130 supports the weight below the scribe 200 during run-in. The preferred embodiment, shown in FIG. 2, employs a single scribe 200 having a V-shaped profile so as to impart a high stress concentration onto the casing wall.

In the preferred embodiment, the scribe 200 is formed on the outer surface of the lower string of casing 130. Further, the scribe 200 is preferably placed around the casing 130 circumferentially. Because the lower string of casing 130 and the expander tool 120 are run into the wellbore 100 together, and because no axial movement of the expander tool 120 in relation to the casing 130 is necessary, the position of the upper expansion members 161 with respect to the scribe 200 can be predetermined and set at the surface of the well or during assembly of the apparatus 105.

FIG. 7, again, shows the expander tool 120 with all of the expansion assemblies 160 and 161 actuated, including the uppermost expansion members 161. In FIG. 7, the scribe 200 has caused a clean horizontal break around a perimeter of the lower string of casing 130 such that a lower portion of the casing 130L has separated from an upper portion 130U thereof. In addition to the expansion assemblies 160 and 161 having been actuated radially outward, the swivel 138 permitted the run-in string 115 and expansion tool 120 to be rotated within the wellbore 100 independent of the casing 130, ensuring that the casing 130 is expanded in a circumferential manner. This, in turn, results in an effective hanging and sealing of the lower string of casing 130 upon the upper string of casing 110 within the wellbore 100. Thus, the apparatus 105 enables a lower string of casing 130 to be hung onto an upper string of casing 110 by expanding the lower string 130 into the upper string 110.

Figure 8:
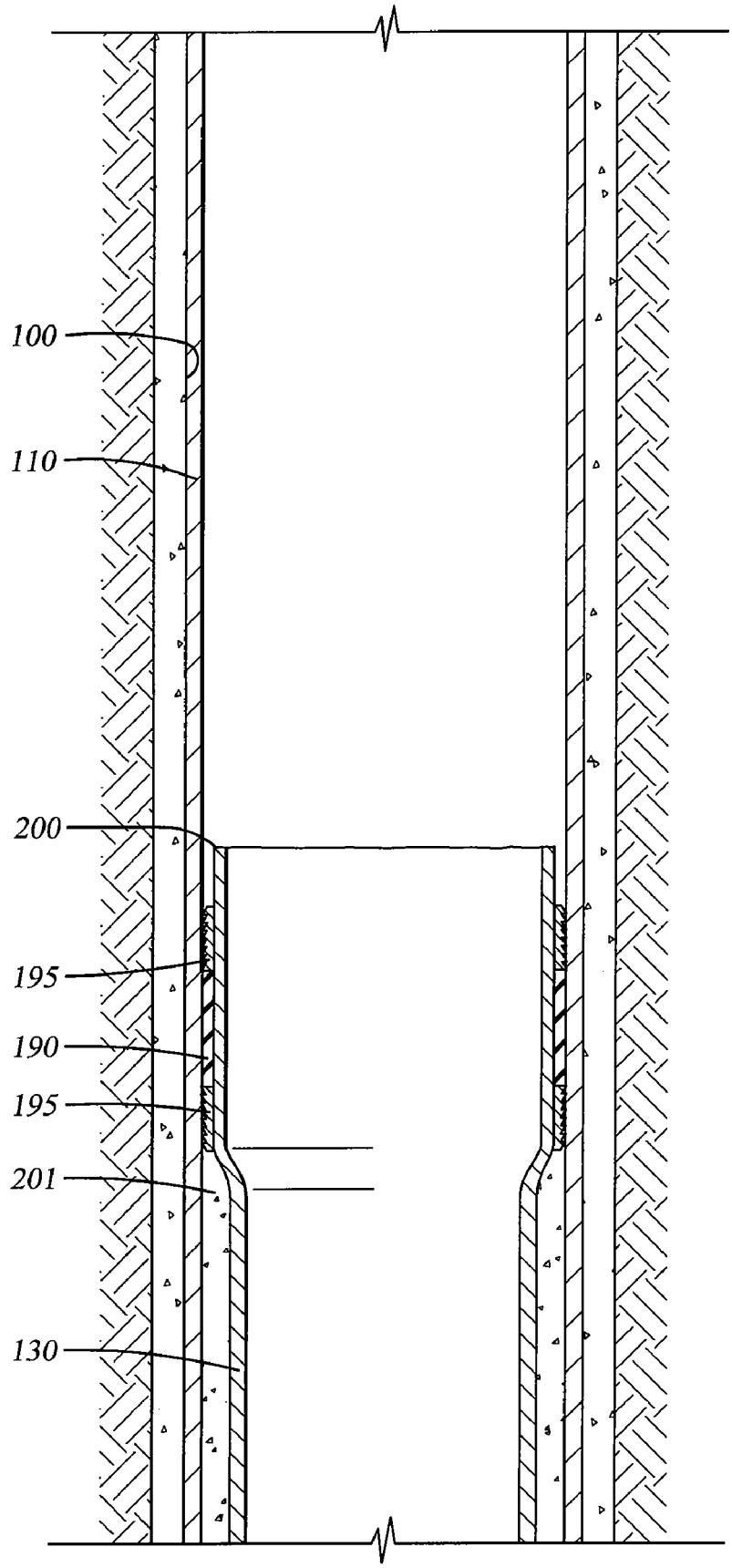
FIG. 8 is a partial section view of the wellbore illustrating a section of the lower casing string expanded into the upper casing string after the expansion tool and run-in string have been removed.

FIG. 8 illustrates the lower string of casing 130 set in the wellbore 100 with the run-in string 115 and expander tool 120 removed. In this view, expansion of the lower string of casing 130 has occurred. The slip rings 195 and the seal ring 190 are engaged to the inner surface of the upper string of casing 110. Further, the annulus 201 between the lower string of casing 130 and the upper string of casing has been filled with cement, excepting that portion of the annulus which has been removed by expansion of the lower string of casing 130.

In operation, the method and apparatus of the present invention can be utilized as follows: a wellbore 100 having a cemented casing 110 therein is drilled to a new depth. Thereafter, the drill string and drill bit are removed and the apparatus 105 is run into the wellbore 100. The apparatus 105 includes a new string of inscribed casing 130 supported by an expander tool 120 and a run-in string 115. As the apparatus 105 reaches a predetermined depth in the wellbore 100, the casing 130 can be cemented in place by injecting cement through the run-in string 115, the expander tool 120 and the tubular member 125. Cement is then circulated into the annulus 201 between the two strings of casing 110 and 130.

With the cement injected into the annulus 201 between the two strings of casing 110 and 130, but prior to curing of the cement, the expander tool 120 is actuated with fluid pressure delivered from the run-in string 115. Preferably, the expansion assemblies 160 (other than the upper-most expansion members 161) of the expander tool 120 extend radially outward into contact with the lower string of casing 130 to plastically deform the lower string of casing 130 into frictional contact with the upper string of casing 110 therearound. The expander tool 120 is then rotated in the wellbore 100 independent of the casing 130. In this manner, a portion of the lower string of casing 130L below the scribe 200 is expanded circumferentially into contact with the upper string of casing 110.

After all of the expansion assemblies 160 other than the uppermost expansion members 161 have been actuated, the uppermost expansion members 161 are actuated. Additional fluid pressure from the surface applied into the bore 168 of the expander tool 120 will cause a temporary connection 162 holding the upper expansion members 161 within the body 150 of the expander tool 120 to fail. This, in turn, will cause the pistons 175 of the upper expansion members 161 to move from a first recessed position within the body 150 of the expander tool 120 to a second extended position. Rollers 165 of the uppermost expansion members 161 then act against the inner surface of the lower string of casing 130L at the depth of the scribe 200, causing an additional portion of the lower string of casing 130 to be expanded against the upper string of casing 110.

As the uppermost expansion members 161 contact the lower string of casing 130, a scribe 200 formed on the outer surface of the lower string of casing 130 causes the casing 130 to break into upper 130U and lower 130L portions. Because the lower portion of the casing 130L has been completely expanded into contact with the upper string of casing 110, the lower portion of the lower string of casing 130L is successfully hung in the wellbore 100. The apparatus 105, including the expander tool 120, the working string 115 and the upper portion of the top end of the lower string of casing 130U can then be removed, leaving a sealed overlap between the lower string of casing 130 and the upper string of casing 110, as illustrated in FIG. 8.

FIGS. 5A-5D depict a series of expansions in sequential stages. The above discussion outlines one embodiment of the method of the present invention for expanding and separating tubulars in a wellbore through sequential stages. However, it is within the scope of the present invention to conduct the expansion in a single stage. In this respect, the method of the present invention encompasses the expansion of rollers 165 at all rows at the same time. Further, the present invention encompasses the use of a rotary expander tool 120 of any configuration, including one in which only one row of roller assemblies 160 is utilized. With this arrangement, the rollers 165 would need to be positioned at the depth of the scribe 200 for expansion. Alternatively, the additional step of raising the expander tool 120 across the depth of the scribe 200 would be taken. Vertically translating the expander tool 120 could be accomplished by raising the working string 115 or by utilizing an actuation apparatus downhole (not shown) which would translate the expander tool 120 without raising the drill string 115.

It is also within the scope of the present invention to utilize a swaged cone (not shown) in order to expand a tubular in accordance with the present invention. A swaged conical expander tool expands by being pushed or otherwise translated through a section of tubular to be expanded. Thus, the present invention is not limited by the type of expander tool employed.

As a further aid in the expansion of the lower casing string 130, a torque anchor may optionally be utilized. The torque anchor serves to prevent rotation of the lower string of casing 130 during the expansion process. Those of ordinary skill in the art may perceive that the radially outward force applied by the rollers 165, when combined with rotation of the expander tool 120, could cause some rotation of the casing 130.

In one embodiment, the torque anchor 140 defines a set of slip members 141 disposed radially around the lower string of casing 130. In the embodiment of FIG. 1, the slip members 141 define at least two radially extendable pads with surfaces having gripping formations like teeth formed thereon to prevent rotational movement. In FIG. 1, the anchor 140 is in its recessed position, meaning that the pads 141 are substantially within the plane of the lower casing string 130. The pads 141 are not in contact with the upper casing string 110 so as to facilitate the run-in of the apparatus 105. The pads 141 are selectively actuated either hydraulically or mechanically or both as is known in the art.

In the views of FIG. 6 and FIG. 7, the anchor 140 is in its extended position. This means that the pads 141 have been actuated to engage the inner surface of the upper string of casing 110. This position allows the lower string of casing 130 to be fixed in place while the lower string of casing 130 is expanded into the wellbore 100.

Figure 9:
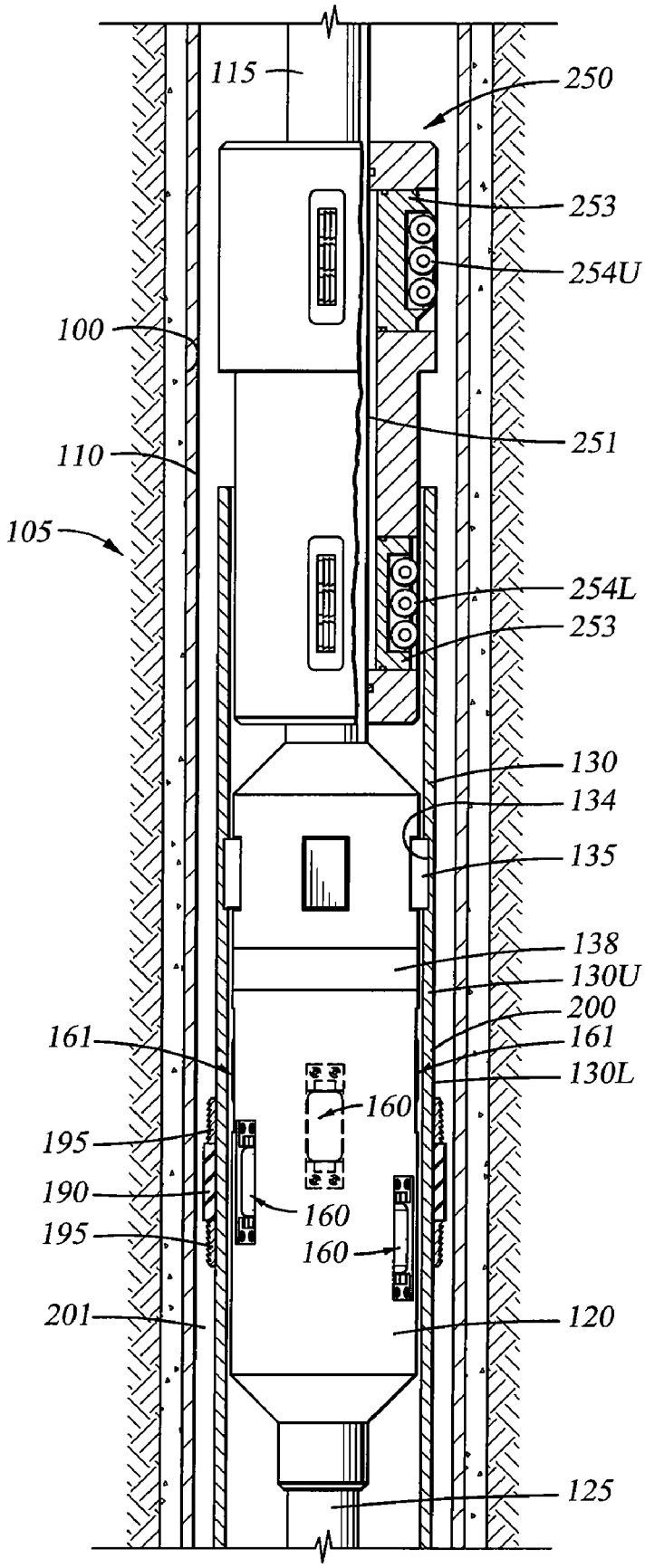
FIG. 9 is a cross-sectional view of an expander tool residing within a wellbore. Above the expander tool is a torque anchor for preventing rotational movement of the lower string of casing during initial expansion thereof. Expansion of the casing has not yet begun.

An alternative embodiment for a torque anchor 250 is presented in FIG. 9. In this embodiment, the torque anchor 250 defines a body having sets of wheels 254U and 254L radially disposed around its perimeter. The wheels 254U and 254L reside within wheel housings 253, and are oriented to permit axial (vertical) movement, but not radial movement, of the torque anchor 250. Sharp edges (not shown) along the wheels 254U and 254L aid in inhibiting radial movement of the torque anchor 250. In the preferred embodiment, four sets of wheels 254U and 254L are employed to act against the upper casing 110 and the lower casing 130, respectively.

Figure 10:
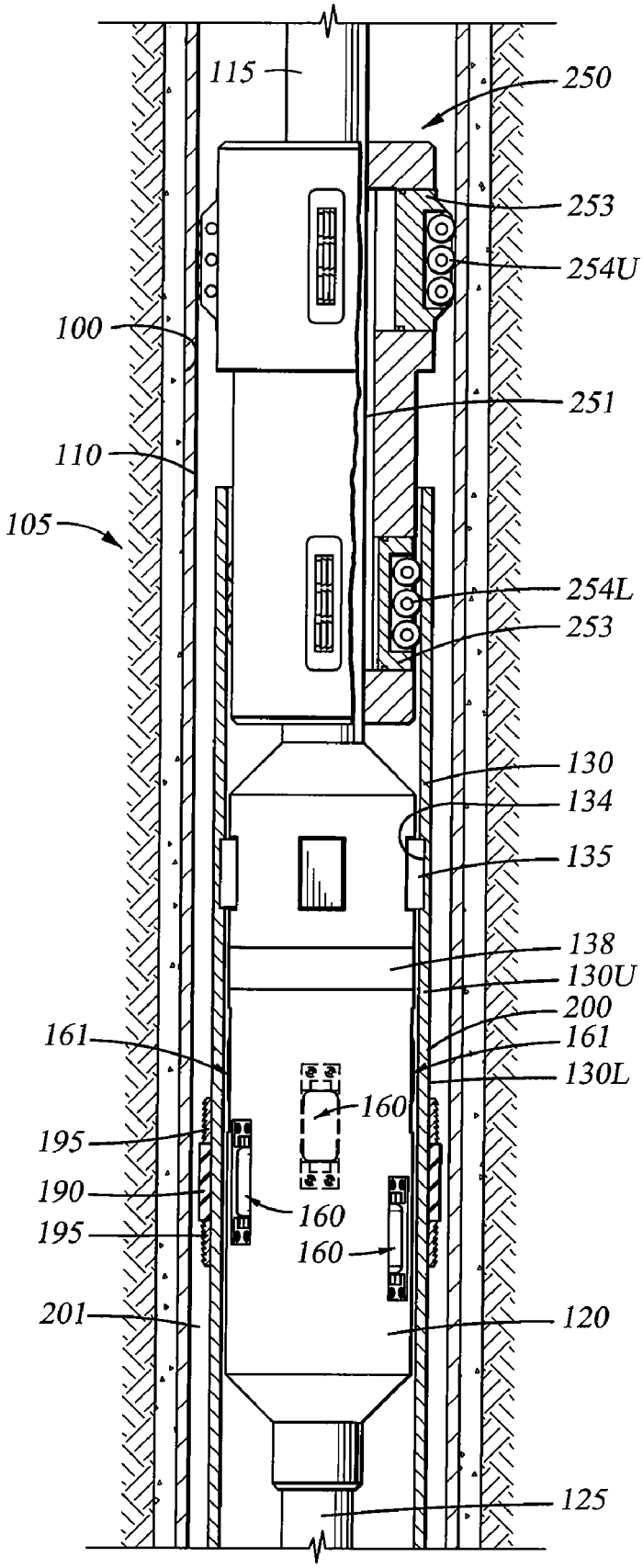
FIG. 10 is a cross-sectional view of an expander tool of FIG. 9. In this view, the torque anchor and expander tool have been actuated, and expansion of the lower casing string has begun.

The torque anchor 250 is run into the wellbore 100 on the working string 115 along with the expander tool 120 and the lower casing string 130. The run-in position of the torque anchor 250 is shown in FIG. 9. In this position, the wheel housings 253 are maintained essentially within the torque anchor body 250. Once the lower string of casing 130 has been lowered to the appropriate depth within the wellbore 100, the torque anchor 250 is activated. Fluid pressure provided from the surface through the working tubular 115 acts against the wheel housings 253 to force the wheels 254C and 254L outward from the torque anchor body 250. Wheels 254C act against the inner surface of the upper casing string 130, while wheels 254L act against the inner surface of the lower casing string 130. This activated position is depicted in FIG. 10.

A rotating sleeve 251 resides longitudinally within the torque anchor 250. The sleeve 251 rotates independent of the torque anchor body 250. Rotation is imparted by the working tubular 115. In turn, the sleeve provides the rotational force to rotate the expander 120.

After the lower casing string 130L has been expanded into frictional contact with the inner wall of the upper casing string 110, the expander tool 120 is deactivated. In this regard, fluid pressure supplied to the pistons 175 is reduced or released, allowing the pistons 175 to return to the recesses 155 within the central body 150 of the tool 120. The expander tool 120 can then be withdrawn from the wellbore 100 by pulling the run-in tubular 115.

Figure 11A:
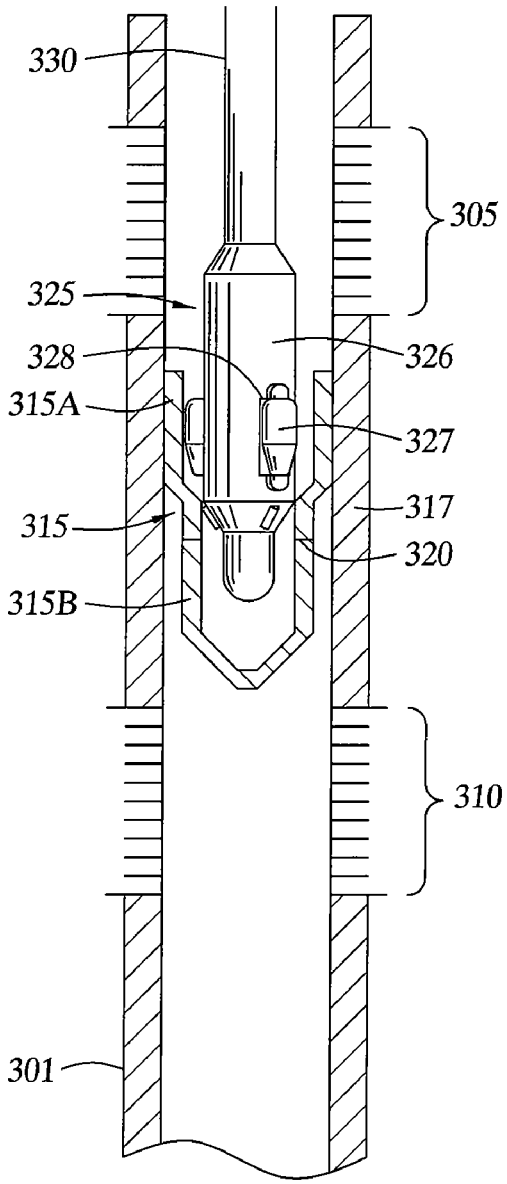
FIGS. 11A-11D illustrate steps in a first embodiment of a plug installation and release operation.

In another embodiment of the present invention, a plug may be temporarily installed within a wellbore to isolate an upper zone of interest in a formation from a lower zone of interest in the formation, as shown in FIGS. 11A-11D. Referring to FIG. 11A, a wellbore 301 exists in an earth formation. Casing 317 is disposed within the wellbore 301 and preferably set therein by cement to form a cased wellbore. The formation has an upper zone of interest 305 and a lower zone of interest 310 therein. Although two zones of interest 305, 310 are shown in FIG. 11A, it is contemplated that the formation may include more than two zones of interest therein. One or more perforations through the casing 317 adjacent to the zones of interest 305, 310 in the formation allow access from the bore of the casing 317 to the zones of interest 305, 310.

Figure 11B:
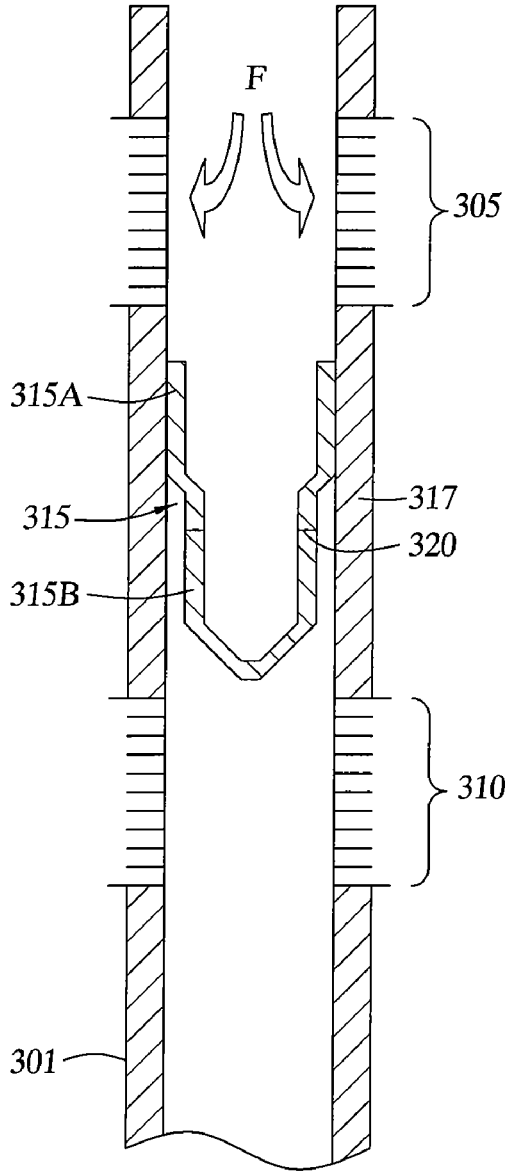

A plug 315 having an upper portion 315A and a lower portion 315B is disposed in the wellbore 301. FIG. 11E shows the plug 315 prior to its expansion. As shown in FIG. 11E, the plug 315 is a generally tubular body having an opening at its upper end and a substantially closed portion at its lower end capable of preventing fluid from flowing therethrough. The closed portion at the lower end of the plug 315 may be semicircular or pointed (as shown in FIGS. 11A-B and FIG. 11E) or of any other shape which provides a sump for at least substantially preventing fluid flow therethrough. Between the upper and lower portions 315A and 315B of the plug 315 is a scribe 320 in the plug 315, which is generally an area of structural weakness in the tubular plug 315 which causes the upper and lower portions 315A and 315B to be shearable from one another upon application of a predetermined force thereto. The scribe 320 is preferably a cut in the tubular plug 315 which causes the plug 315 to break into separate upper and lower portions 315A and 315B upon application of radial force at or near the scribe 320. The shape and extent of the cut of the scribe 320 into the plug 315 is generally as shown and described above in relation to the scribe 200 of FIGS. 1-10.

The outer diameter of the plug 315, especially at the upper portion 315A, may employ one or more gripping members (preferably slips, not shown) and/or one or more sealing members (preferably seals, not shown) for grippingly engaging and/or sealingly engaging, respectively, the casing 317 upon radial expansion of the plug 315 (see below). The one or more gripping members may include the at least one slip member 195 shown and described above in relation to FIGS. 1-10.

The one or more sealing elements may include one or more sealing rings 190 as shown and described in relation to FIG. 6 above. Referring again to FIGS. 11A-D, in addition to or in lieu of the one or more sealing rings 190, the one or more sealing elements may include coating the outer diameter of at least a portion of the plug 315 with an elastomer, soft metal, or epoxy to anchor the plug 315 within the wellbore 301 and create a seal of the plug 315 against the casing 317. Additionally, the one or more sealing elements may include the sealing arrangement shown and described in U.S. Pat. No. 6,425,444 entitled "Method and Apparatus for Downhole Sealing," which is herein incorporated by reference in its entirety.

At least a portion of the upper portion 315A of the plug 315 is expandable upon application of radial expansion force to its inner diameter. The upper portion 315A is expandable past its elastic limits by the radial expansion force.

FIG. 11A shows an expander tool 325 disposed within the plug 315. The expander tool 325 is operatively connected to a lower end of a working string 330. The working string 330 translates the expander tool 325 longitudinally and/or laterally into and within the wellbore 301 during various stages of the operation and may provide a fluid path to the expander tool 325.

The expander tool 325 is preferably similar to the expander tool shown and described in U.S. Pat. No. 6,702,030, filed on Aug. 13, 2002, which is herein incorporated by reference in its entirety. Specifically, the expander tool 325 is connected to the working string 330 directly or via a downhole motor (not shown) so that it is rotatable relative to the plug 315. The expander tool 325 includes a generally cylindrical body 326 having one or more windows 328 therein housing one or more expander members 327 radially extendable from the windows 328 and retractable back into the windows 328 after extension. Each expander member 327 is disposed on an axle (not shown) supported at each end by a piston (not shown). A piston surface (not shown) opposite the piston is acted on by pressurized fluid in a longitudinal bore (not shown) formed within the body 326 of the expander tool 325 to cause the expander members 327 to extend radially outward. The expander members 327 are preferably roller members which are rollable relative to the body 326.

In essence, the expander tool 325 may be the rotary expander tool 120 shown and described in relation to FIGS. 1-10 with only one row of roller assemblies 160. Unlike the expander tool 120 shown and describe in relation to FIGS. 1-10, the expander tool 325 has expander members 327 extendable at the same time. In an alternate embodiment, the expander tool 120 having rollers 165 extendable at different times of FIGS. 1-10 may be employed in the embodiment shown in FIGS. 11A-D instead of the expander tool 325. In further alternate embodiments, any type of expander tool, including a mechanical, cone-type expander tool, or internal pressure may be utilized with the embodiment shown and described in relation to FIGS. 11A-D.

In operation, the plug 315 is utilized when it is desired to isolate a portion of the wellbore 301 from another portion of the wellbore 301, for example to isolate the upper zone of interest 305 from the lower zone of interest 310. Isolating the upper zone of interest 305 from the lower zone of interest 310 permits fluid to access the upper zone of interest 305, while preventing fluid from accessing the lower zone of interest 310. Providing fluid access to only the upper zone of interest 305 allows the performance of one or more treatment operations, for example fracturing operations, acidizing operations, and/or testing operations, at the upper zone of interest 305 without performing the same operation on the lower zone of interest 310.

In the first step of the operation, the expander tool 325 may be inserted into the open upper end of the upper portion 315A of the plug 315 and operatively connected to the inner diameter of the plug 315. The plug 315 at this state of the operation, prior to expansion, is shown in FIG. 11E. The expander tool 325 may be operatively connected to the plug 315 by a shearable or threadable connection, or by any other temporary connection known to those skilled in the art. The expander tool 325 and the plug 315 are lowered into the previously-formed wellbore 301, with the closed lower end of the lower portion 315B of the plug 315 pointing downward, using the working string 330 operatively connected to the expander tool 325. The expander tool 325 may be operatively connected to the working string 330 by a shearable or threadable connection, or by any other temporary connected known to those skilled in the art. Alternatively, the connection between the working string 330 and the expander tool 325 may be permanent.

The assembly including the expander tool 325 and the plug 315 is then lowered into the wellbore 301 into a position to isolate the upper zone of interest 305 from the lower zone of interest 310. Specifically, the plug 315 is positioned between the upper zone of interest 305 and the lower zone of interest 310, with the closed portion pointing downward within the wellbore 301. Next, the expander tool 325 is rotated and internally pressurized to cause the expander members 327 to exert a radial force on the surrounding upper portion 315A of the plug 315, thereby expanding the outer diameter of the surrounding portion of the plug 315 into frictional contact with the inner diameter of the casing 317 therearound. The rotation of the expander tool 325 may occur prior to, during, or after the expander members 327 exert the radial force on the upper portion 315A.

Other types of expander tools usable in alternate, embodiments of the present invention may not have extendable members 327; therefore, other embodiments may use other means for exerting radial force on the plug 315. Additionally, other means of expansion usable as the expander tool in alternate embodiments may not require rotation to expand the circumference of the plug 315.

Instead of running the expander tool 325 and the plug 315 into the wellbore 301 together, as described above, in an alternate embodiment the plug 315 is run into the wellbore 301 and hung on the casing 317 by a hanging member such as a liner hanger. subsequently, the expander tool 325 may be lowered into the plug 315 to expand a portion of the plug 315 into sealing contact with the surrounding casing 317. In a further alternate embodiment, the plug 315 may be set in place using the embodiments shown and described above in relation to FIGS. 1-10 or by any other expansion tool or method known to those skilled in the art.

Once the outer diameter of the expanded portion of the plug 315 is in frictional contact with the casing 317 to grippingly engage the casing 317, the plug 315 is anchored within the wellbore 301. Thus, the connection between the expander tool 325 and the inner diameter of the plug 315 may be released (e.g., by shearing the shearable connection or by unthreading the threadable connection). (In the alternate embodiment where the expander tool 325 is run in after the plug 315, there is no connection to be released; therefore, this step in the operation is not necessary.) The expander tool 325 may be translated upward or downward (and may be simultaneously rotated if desired) to expand an extended portion of the upper portion 315A of the plug 315. The portion of the upper portion 315A which is expanded at this point in the operation does not include the scribe 320 or portions of the upper portion 315A which are sufficiently weakened by the presence of the scribe 320 to cause the lower portion 315B of the plug 315 to break away from the upper portion 315A of the plug 315. FIG. 11A shows the expander tool 325 expanding an extended length of the upper portion 315A of the plug 315.

After the desired length of the upper portion 315A is expanded into the casing 317, the expander tool 325 may be removed from the wellbore 301. FIG. 11B shows the plug 315 set within the wellbore 301 after the expander tool 325 is removed. Fluid F, such as fracturing, acidizing, or other treatment fluid, may be introduced into the casing 317. Because the plug 315 is closed at its lower end, the plug 315 separates the upper and lower zones of interest 305, 310 to prevent fluid flow into the lower zone of interest 310, and fluid F buildup on the plug 315 forces the fluid F outward into the upper zone of interest 305 to treat the upper zone of interest 305. FIG. 11B shows fluid F flowing into the upper zone of interest 305.

Further treatment(s), production, and/or testing may be conducted on the upper zone of interest 305 while the lower zone of interest 310 remains isolated. The expander tool 325 is then again lowered into the wellbore 301 adjacent to the unexpanded portion of the upper portion 315A. The expander tool 325 is then activated as described above to exert a radial force on the plug 315 and expand the unexpanded portion of the upper portion 315A of the plug 315 past its elastic limits. Again, the expander tool 325 may be rotated to expand the plug 315 circumferentially, and then the expander tool 325 may be lowered (and may be simultaneously rotated) to expand the length of the upper portion 315A of the plug 315.

Figure 11C:
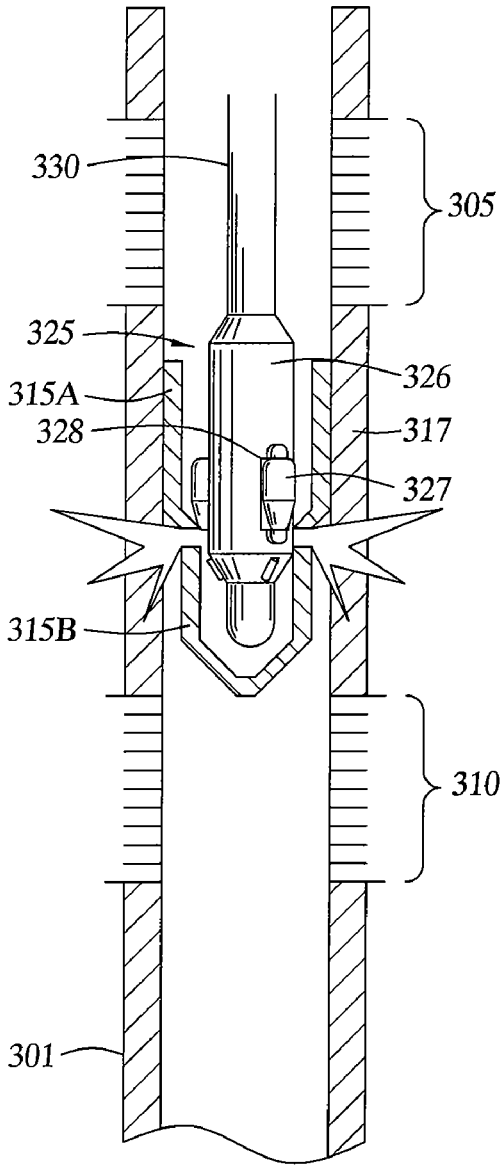
Figure 11D:
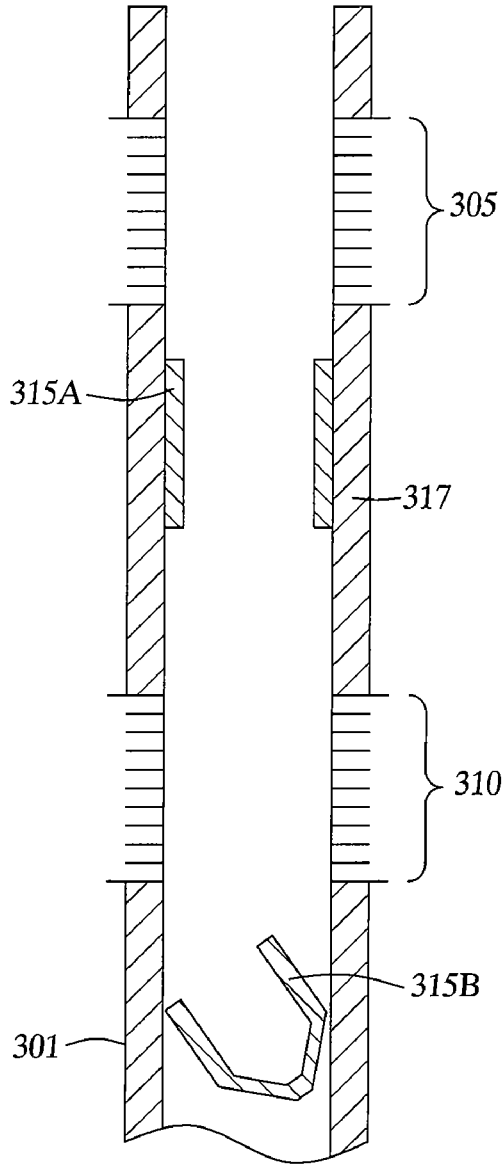
Figure 11E:
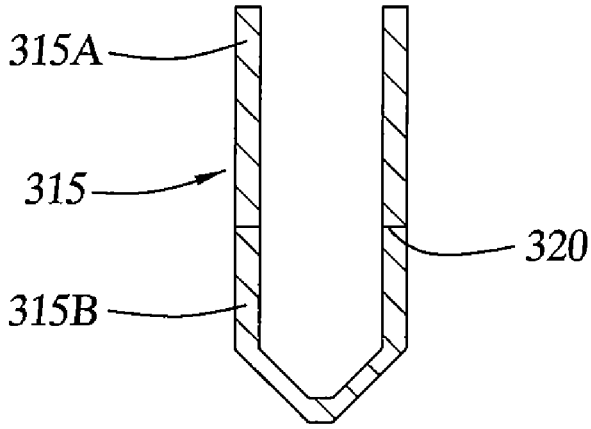
FIG. 11E shows a plug used in the plug installation and release operation of FIGS. 11A-11D prior to its installation within the wellbore.

Eventually, the expander tool 325 reaches the scribe 320 in the plug 315 (or a weakened portion of the plug 315 proximate to the scribe 320), which causes the lower portion 315B to separate from the upper portion 315A of the plug 315, as shown in FIG. 11C. The expansion at or near the scribe 320 thus forces the lower portion 315B to travel downward within the wellbore 301. Any unexpanded portion of the upper portion 315A of the plug 315 may then be expanded by the expander tool 325, as shown in FIG. 11D.

The operation above was described and shown in terms of expansion of the plug 315 from the upper portion 315A down to the scribe 320. In another embodiment, the portions 315A, 315B may be separated from one another by expanding the lower portion 315B and moving the expander tool 325 upward to the weakened location on the plug 315 at or near the scribe 320.

Ultimately, the lower portion 315B may travel downward within the wellbore 301, preferably below the lower zone of interest 310. The lower portion 315B of the plug 315 landing below the lower zone of interest 310 permits unobstructed access (e.g., for wellbore tools and/or flow of treatment and/or production fluid) through the casing 317 to and from the lower zone of interest 310. Expansion of the entire length of the upper portion 315A of the plug 315 remaining in contact with the casing 317 between the upper and lower zones 305, 310, even after the lower portion 315B is sheared, to a substantially uniform inner diameter allows favorable access to the lower zone of interest 310 after the operation is performed using the temporary plug 315. FIG. 11D shows the lower portion 315B of the plug 315 falling into the bottom of the wellbore 301 and the entire length of the upper portion 315A expanded into frictional contact with the casing 317. The lower portion 315B may ultimately rest at the bottom of the wellbore 301. If desired, the lower portion 315B may be washed away or drilled through by a cutting structure.

Figure 11F:
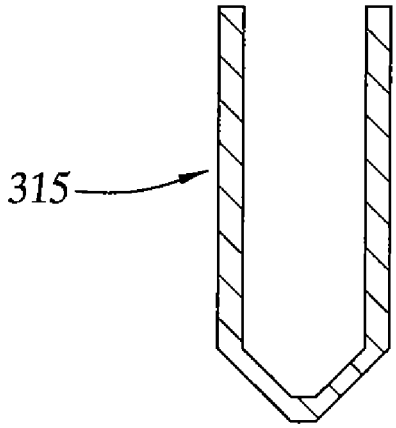
FIG. 11F shows an alternate embodiment of a plug usable in the plug installation and release operation of FIGS. 11A-D prior to its installation within the wellbore.

FIG. 11F shows an alternate embodiment of the plug 315 which may be utilized in the operation shown and described in relation to FIGS. 11A-E. The plug 315 illustrated in FIG. 11F is substantially similar in structure to the plug shown and described above in relation to FIG. 11E, with the only difference being that the plug 315 of FIG. 11F does not include the scribe 320. If it is desired to separate the plug 315 of FIG. 11F into two or more portions and/or to remove or otherwise retrieve one or more of portions of the plug 315 from the wellbore 301 (see description below in FIGS. 14A-C below of a plug retrieval operation) to allow communication between the upper and lower zones of interest 305, 310, a severing tool which is capable of severing tubulars may be utilized to sever the plug 315 into two or more portions. Any severing tool known to those skilled in the art may be utilized to sever the plug 315. Any other method or apparatus for severing a tubular may be utilized which is known to those skilled in the art to separate the plug 315 into two or more portions.

Figure 14A:
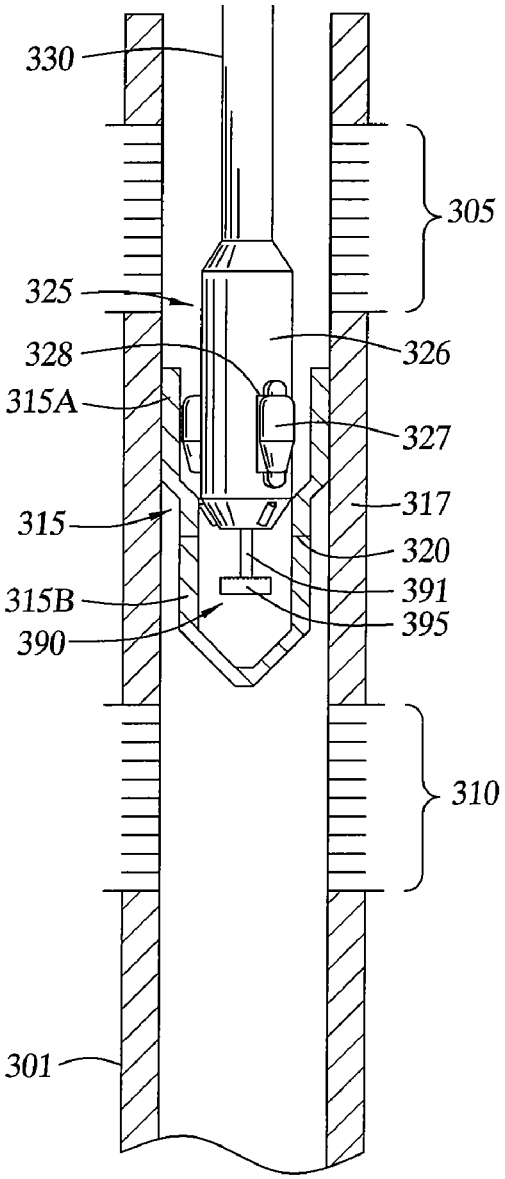
FIGS. 14A-C illustrate steps in a plug removal operation.
Figure 14B:
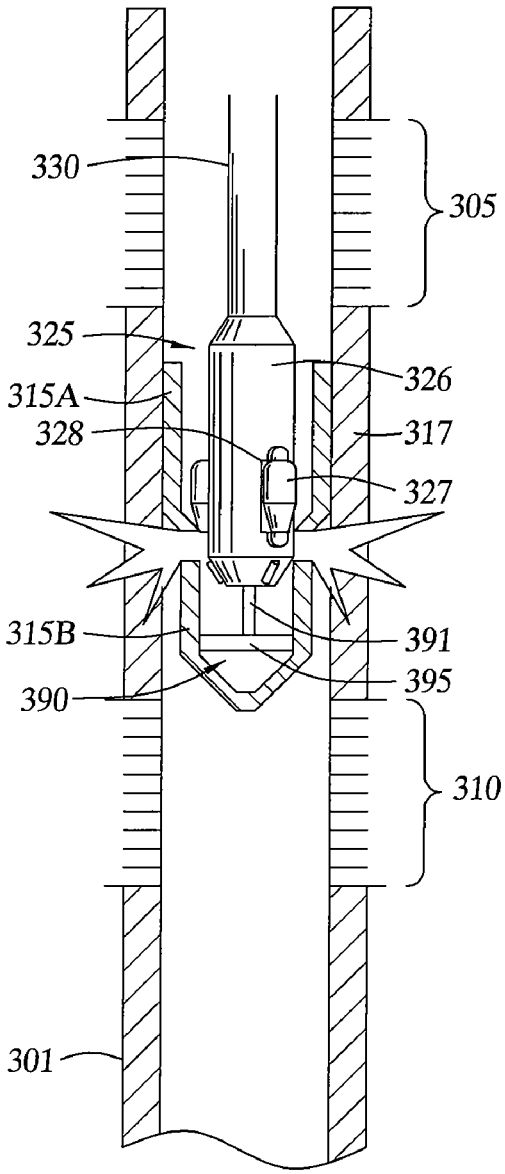
Figure 14C:
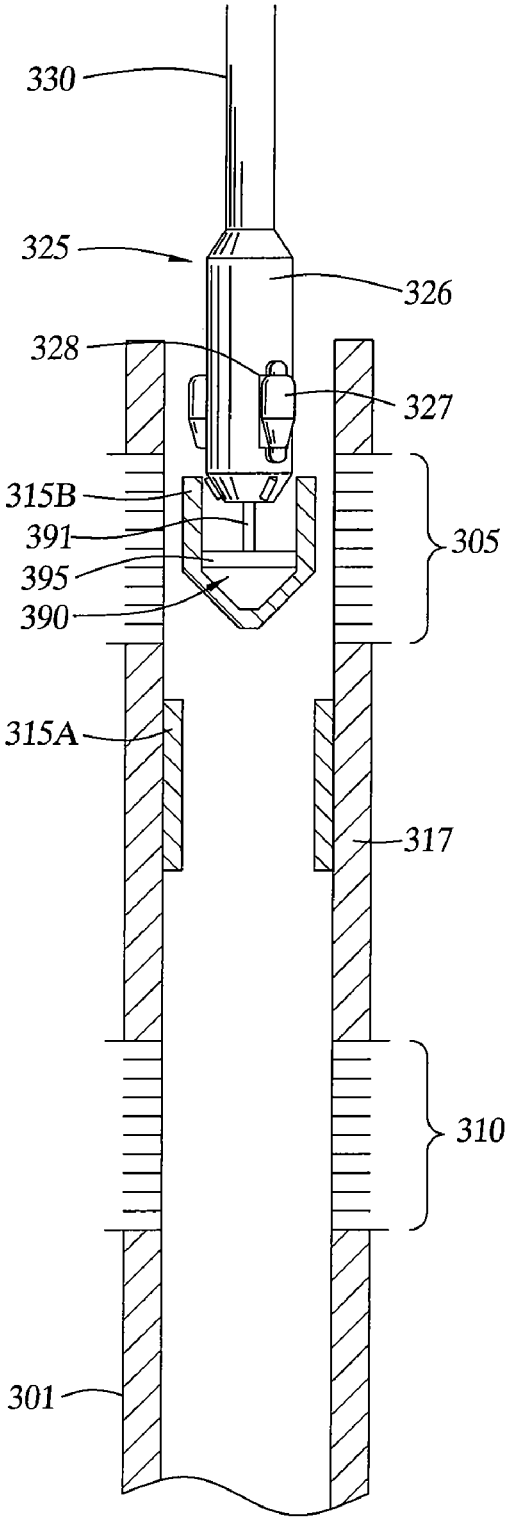

In an alternate embodiment, as shown in FIGS. 14A-C, the lower portion 315B is retrieved from the wellbore 301 after the lower portion 315B is separated from the upper portion 315A. The operation of the embodiment shown in FIGS. 14A-C is substantially the same as the operation of the embodiment shown in FIGS. 11A-E, so only the portions of the operation in the embodiment of FIGS. 14A-C which differ from the operation of the embodiment of FIGS. 11A-E are described below.

FIG. 14A shows the plug 315 installed within the wellbore 301. The working string 330 and the expander tool 325 are connected to one another as described above in relation to FIGS. 11A-C, but an upper end of a support member 391 of a retrieval tool 390 may be operatively connected to a lower end of the expander tool 325 by a threaded connection or any other means of connection known by those skilled in the art. The support member 391 may have thereon one or more extendable retrieving members 395 which are extendable and retractable radially during various stages of the plug removal operation to latchingly engage the plug 315 from its inner diameter. The latching engagement may alternatively include any type of interlocking profile, fishing/retrieval device, or an arrangement similar to the interlock shown and described in U.S. Pat. No. 6,543,552 filed Dec. 22, 1999 and entitled "Method and Apparatus for Drilling and Lining a Wellbore," which is incorporated by reference herein.

As shown in FIG. 14A, the working string 330, expander tool 325, and retrieval tool 390 may be run into the inner diameter of the plug 315. During run-in, the retrieving members 395 as well as the expander members 327 may be retracted to the smaller outer diameter to allow clearance between the outer diameter of the retrieving members 395 and expander members 327 and the inner diameter of the plug 315. In an alternate embodiment, the working string 330, expander tool 325, and retrieval tool 390 may be run into the wellbore 301 at the same time as the plug 315.

Once the expander tool 325 is located adjacent to the scribe 320 or adjacent to a weakened portion of the plug 315 proximate to the scribe 320, the expansion of the plug 315 by the expander tool 325 begins. The plug 315 is expanded while the retrieving members 395 latch into the inner diameter of the lower portion 315B of the plug 315, thereby grippingly engaging the lower portion 315B. The expander members 327 expand the plug 315 past its elastic limit and separate the upper and lower portions 315A and 315B from one another at or near the scribe 320. FIG. 14B shows the upper and lower portions 315A and 315B separated from one another and the retrieval tool 390 grippingly engaging the lower portion 315B of the plug 315. The remaining unexpanded length of the upper portion 315A may then be expanded by the expander tool 325.

When the desired expansion of the upper portion 315A is completed, the retrieval tool 390 remains latched with the inner diameter of the lower portion 315B. The working string 330 is then pulled upward to the surface of the wellbore 301, pulling the expander tool 325, retrieval tool 390, and lower portion 315B of the plug 315 therewith. FIG. 14C shows the retrieval tool 390 latched with the lower portion 315B and being pulled to the surface of the wellbore 301.

Although the embodiment of FIGS. 14A-C as described above involves expanding the plug 315 while the latching is accomplished, the latching of the plug 315 may take place at any point during the plug removal operation. Specifically, the latching of the plug 315 may be accomplished before, during, or after expansion of the plug 315. Moreover, the expansion may be halted at any time and any number of times before the scribe 320 or a weakened portion near the scribe 320 is reached by the expander tool 325 to allow one or more checks to determine whether the plug 315 is latched properly.

Also, latching of the plug 315 may be accomplished by any other mechanism, including but not limited to any fishing tool, known by those skilled in the art which is capable of performing a latching function. Although the retrieval tool 390 shown and described above in relation to FIGS. 14A-C includes extendable retrieving members 395, it is within the scope of embodiments of the present invention that any fishing tool or latching tool known to those skilled in the art may be used to perform the latching function, including fishing tools or latching mechanisms which do not have retractable or extendable members or which do not move at all. Basically, the latching tool or fishing tool must only be capable of latching with the plug 315 to move the plug 315 within the wellbore 301.

To possibly eliminate the need to remove a portion of the plug 315 from the wellbore 301 as well as to eliminate a portion of the plug 315 from falling into the wellbore 301 upon separation of the plug 315, the embodiment shown in FIGS. 15A-J may be utilized. Because the embodiment shown in FIGS. 15A-15J is substantially similar to the embodiment shown and described in relation to FIGS. 11A-E, similar parts of FIGS. 15A-J which operate in similar ways are labeled with like numbers to those in FIGS. 11A-E. The above description regarding FIGS. 11A-E applies equally to the embodiment of FIGS. 15A-J, except as described below.

An alternate embodiment of the plug 315 is shown in FIG. 15A. The plug 315 includes a generally tubular body having a longitudinal bore therethrough and including a first portion 315C and a second portion 315D. The first portion 315C extends from the upper end of the plug 315 and preferably has a generally uniform inner diameter along its length. In contrast, the second portion 315D converges from a larger inner diameter at its upper end where the second portion 315D meets the first portion 315C to an increasingly small inner diameter at the closed lower end of the tubular body of the plug 315. Although the embodiment shown in FIG. 15A illustrates a converging second portion 315D, any shape of the second portion which produces a closed lower end to the plug 315 is within the scope of embodiments of the present invention.

Within the second portion 315D are one or more weakened areas of the plug 315, preferably one or more scribes 320 as described above. FIG. 15B shows a downward cross-sectional view of the plug 315 of FIG. 15A. As shown in FIG. 15B, the scribes 320 are preferably disposed at defined intervals around the second portion 315D to facilitate opening up of the lower end of the plug 315, as described below.

Figure 15J:
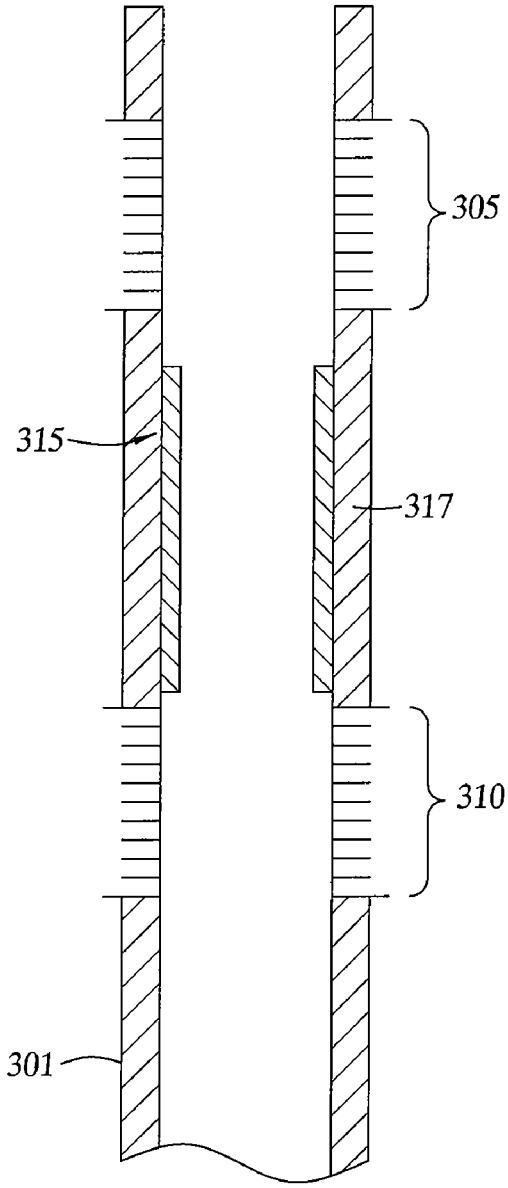
Figure 15H:
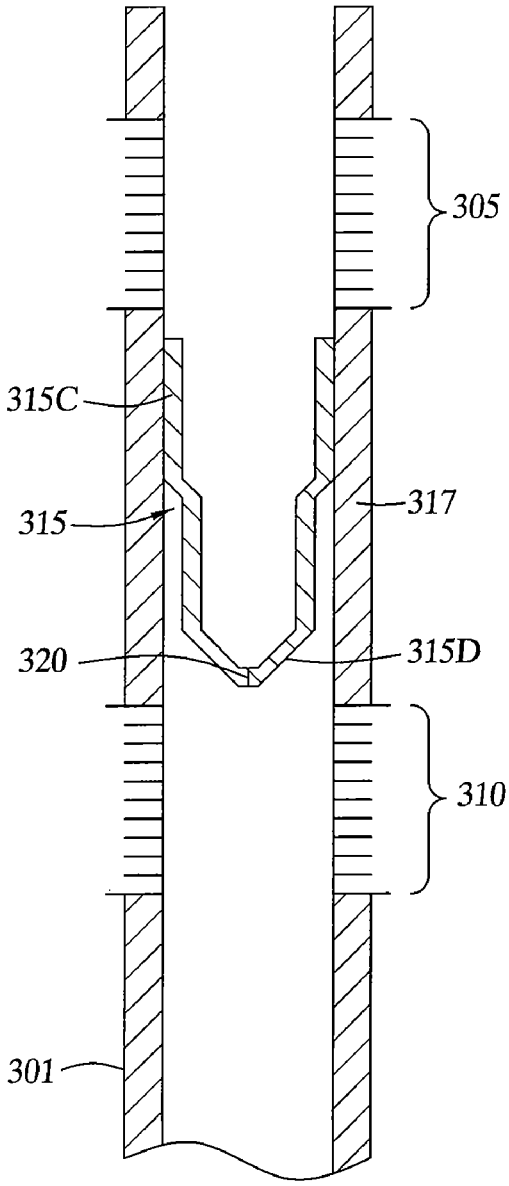

In operation, the plug 315 is lowered into the wellbore 301 to an area between the two zones of interest 305, 310, and at least a portion of the upper portion 315C is expanded into frictional contact with the casing 317 within the wellbore 301 by the expander tool 325. The expander tool 325 may be lowered into the wellbore 301 at the same time as the plug 315 or at some time after the plug is hung from the casing 317. FIG. 15H shows a portion of the upper portion 315C expanded into frictional and sealing contact with the casing 317. FIG. 15C shows the plug 315 at this step in the operation. At this point, the upper zone of interest 305 and lower zone of interest 310 are sealingly isolated from one another.

Fluid, such as fracturing, acidizing, or other treatment fluid, may be introduced into the casing 317. Because the plug 315 is closed at its lower end, the plug 315 separates the upper and lower zones of interest 305, 310 to prevent fluid flow into the lower zone of interest 310, and fluid buildup on the plug 315 forces the fluid outward into the upper zone of interest 305 to treat the upper zone of interest 305. Further treatment(s), production, and/or testing may be conducted on the upper zone of interest 305 while the lower zone of interest 310 remains isolated.

Figure 15I:
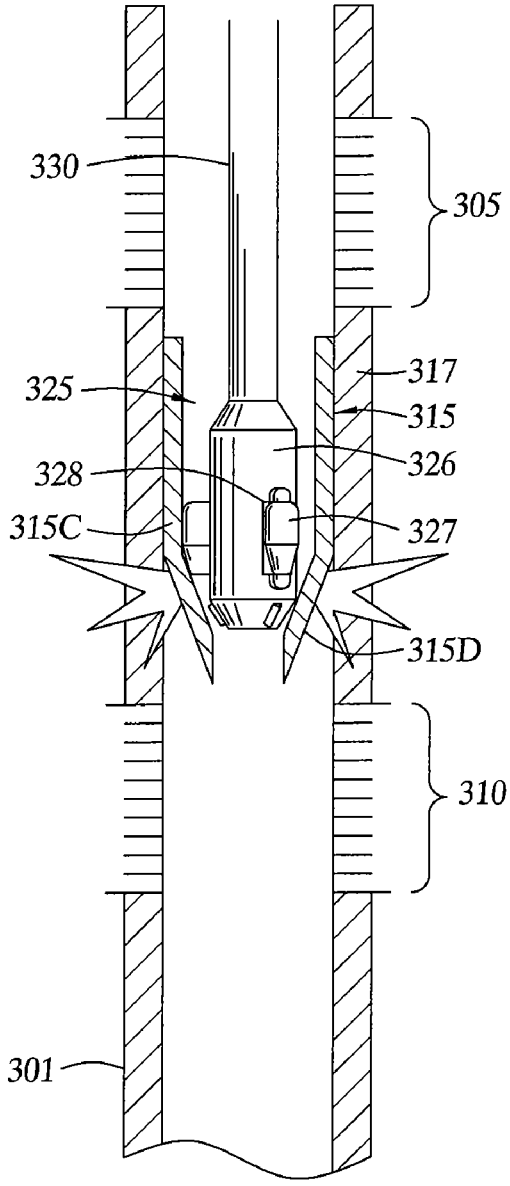

When it is desired to allow access from the upper zone of interest 305 to the lower zone of interest 310 (and vice versa), an expander tool 325 may be used to expand the plug 315 at the one or more scribes 320 to open the plug 315 at the one or more scribes 320. Optionally, any remaining unexpanded portion of the first portion 315C may be expanded prior to expanding at the scribes 320. Expanding the plug 315 at the one or more scribes 320 causes the plug 315 to sever at its lower end, as shown in FIG. 15I, thereby allowing communication between the upper and lower areas of interest 305, 310. FIG. 15D shows the plug 315 being expanded so that the plug 315 separates at its lower end, and FIG. 15E shows a downward cross-sectional view of the plug 315 of FIG. 15D partially expanded at this step in the operation.

Optionally, the second portion 315D may be fully expanded along its length into frictional contact with the casing 317 so that the inner diameter of the plug 315 is substantially uniform along the length of the bore. FIG. 15J shows the plug 315 expanded along its length to provide a substantially uniform bore inner diameter. FIG. 15F shows the fully expanded plug 315 and illustrates the indentions within the second portion 315D at the former scribes 320. FIG. 15G illustrates a downward cross-sectional view of the fully expanded plug 315 of FIG. 15F. The embodiment shown in FIGS. 15A-J advantageously eliminates the need to remove or retrieve any portion of the plug 315 while still allowing substantially unrestricted access between wellbore portions formerly separated by the plug 315.

The terms "upper zone of interest" and "lower zone of interest," as described above, are not limited to the directions of "upper" and "lower". Rather, the terms are relative terms and may constitute separate zones within any type of wellbore, including but not limited to left and right zones within a horizontal or lateral wellbore.

In yet a further alternate embodiment of the present invention, a packer integral to a tubular may be employed within a wellbore, as shown in FIGS. 12A-E. The packer may be deployed, and subsequently, at least a portion of the tubular may be removed from the wellbore and possibly replaced or the portion of the tubular remaining in the wellbore supplemented with another tubular. A portion of the tubular remaining in the wellbore could act as a polished bore receptacle for receiving an additional tubular therein. The replacement or supplemental tubular may also include a packer integral thereto. The expandable tubular may thus perform dual functions of packing off an area within the wellbore by use of the expandable packer aspect of the expandable tubular and facilitating the location of replacement or supplemental tubulars within the wellbore by use of the packer bore receptacle aspect of the expandable tubular.

Figure 12A:
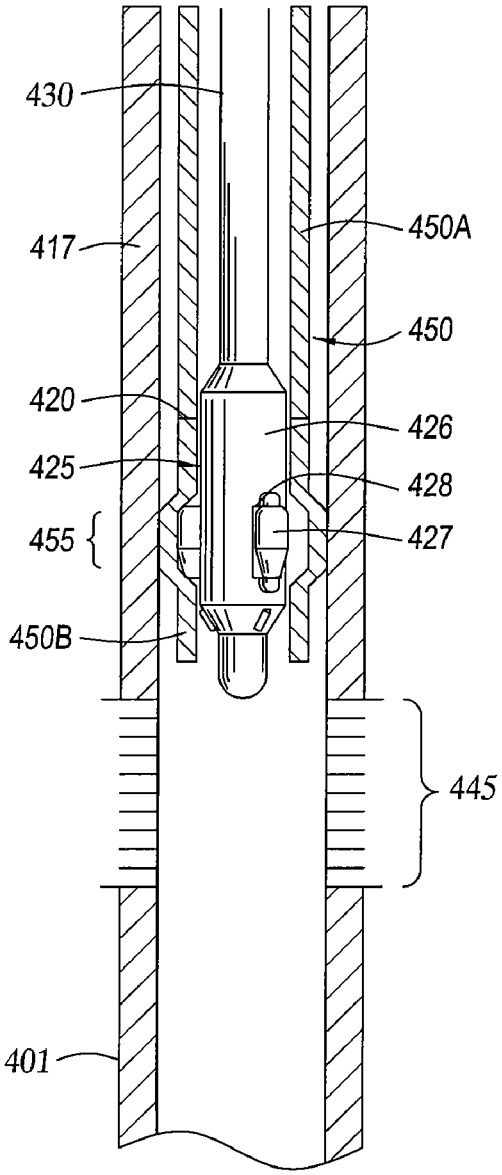
FIGS. 12A-12E illustrate steps in a packing element installation and release operation.

Referring to FIG. 12A, a wellbore 401 is formed within an earth formation. The formation may have a zone of interest 445 therein, which may be of interest because it contains production fluid and/or because it is an area in the formation which needs to be treated with one or more fluids. The wellbore 401 has casing 417 disposed therein. The casing 417 is preferably set within the wellbore 401 by cement.

Within the casing 417 is a first tubular 450. The first tubular 450 has an upper portion 450A and a lower portion 450B and, although not shown in an undeformed state, begins with essentially a uniform inner diameter along its length. A first scribe 420 is provided on the first tubular 450 between the upper and lower portions 450A, 450B to weaken the first tubular 450 at a location at or near the first scribe 420. The first scribe 420 is substantially the same as the scribe 320 shown and described in relation to FIGS. 11A-E.

A first expandable packer portion 455 is located within the lower portion 450B of the first tubular 450. The first expandable packer portion 455 becomes a packer upon expansion by grippingly and sealingly engaging the inner diameter of the casing 417 with the outer diameter of the first expandable packer portion 455 of the first tubular 450.

One or more sealing elements (not shown) may be disposed on the outer diameter of at least a portion of the first expandable packer portion 455 to sealingly engage the inner diameter of the surrounding casing 417 (or the wellbore wall in the case of an open hole wellbore). The one or more sealing elements may include an elastomeric, soft metal, or epoxy coating on the outer diameter of at least a portion of the first expandable packer portion 455 to anchor the first tubular 450 against the casing 417 and to create a seal against the casing 417. The one or more sealing elements may include the sealing arrangement shown and described in U.S. Pat. No. 6,425,444, which was above incorporated by reference, to create a downhole seal between the outer diameter of the first tubular 450 and the surrounding casing 417 (or the wall of an open hole wellbore). The one or more sealing elements may alternately or additionally include one or more sealing rings 190 as shown and described above in relation to FIG. 6.

One or more gripping elements (not shown) may also be disposed on the outer diameter of at least a portion of the first expandable packer portion 455 to frictionally engage the inner diameter of the surrounding casing 417. The one or more gripping elements may include at least one slip member 195, as shown and described above in relation to FIGS. 1-10.

Disposed within the first tubular 450 is an expander tool 425 operatively connected to a working string 430, each of which is in structure and operation substantially similar to the expander tool 325 and working string 330, respectively, shown and described in relation to FIGS. 11A-D; therefore, in FIGS. 12A-E, like numbers in the "400" series are used to designate the expander tool 425 and associated parts to numbers in the "300" series used to designated the expander tool 325 and associated parts of FIGS. 11A-D.

Figure 12B:
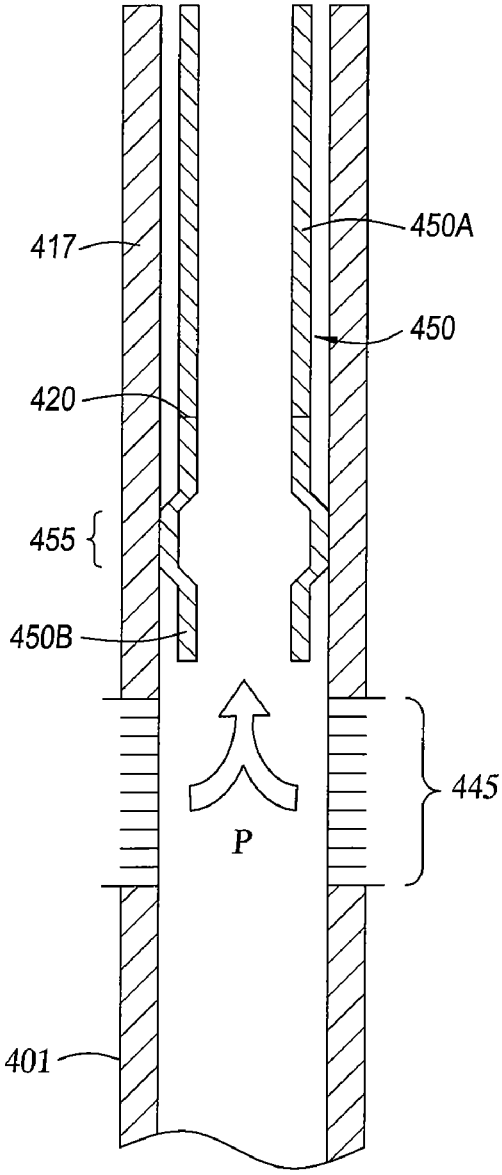
Figure 12C:
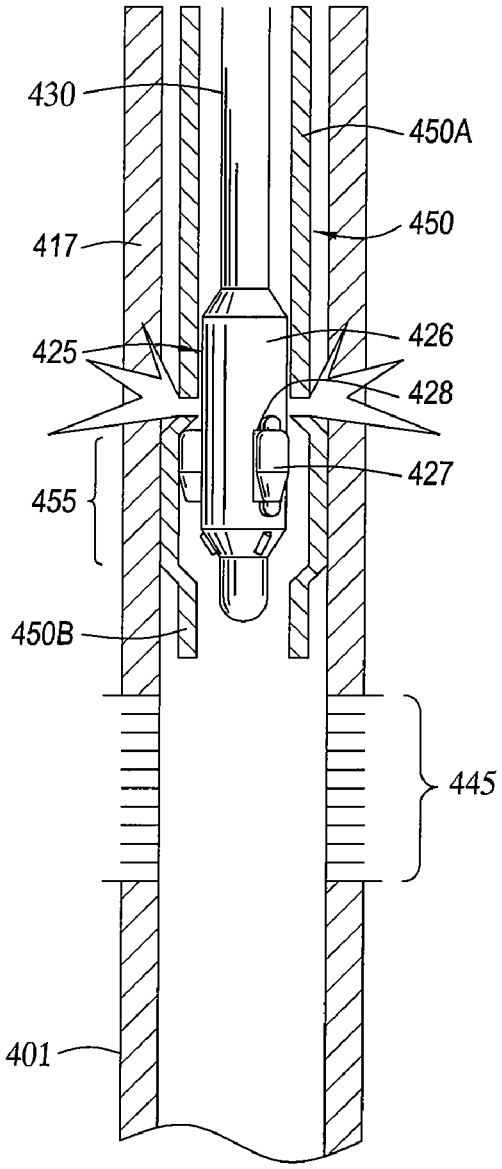
Figure 12D:
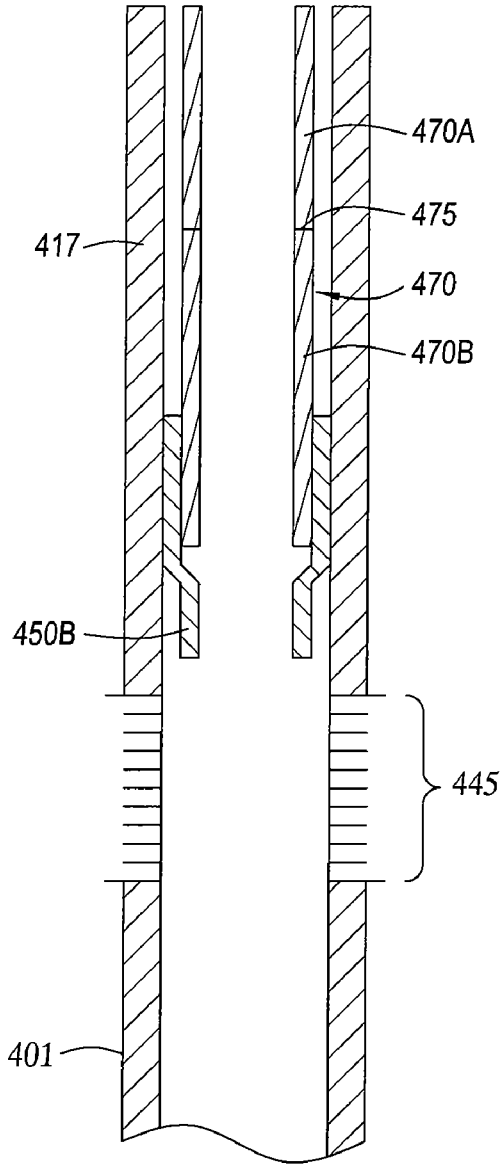

FIG. 12D shows a second tubular 470 disposed within the wellbore 401 within the lower portion 450B of the first tubular 450. The second tubular 470 is substantially similar to the first tubular 450 described above. Specifically, the second tubular 470 includes upper and lower portions 470A and 470B separated by a second scribe 475 formed within the second tubular 470 to weaken a portion of the second tubular 470. Also, the lower portion 470B includes a second expandable packer portion 480 which is formed upon expansion of the portion 480 of the second tubular 470 (described below) which is more easily recognized in FIG. 12E. The second expandable packer portion 480 may include one or more sealing elements (not shown) and/or one or more gripping elements (not shown) as described above in relation to the first expandable packer portion 455.

The operation of the integral tubular packer arrangement is shown in FIGS. 12A-E. The wellbore 401 is formed in the formation, preferably to intersect one or more zones of interest 445 in the formation. The expander tool 425 and connected working string 430 may be disposed within the first tubular 450 and operatively and releasably connected to the inner diameter of the first tubular 450 by threaded connection or shearable connection, as described above in relation to the expander tool 325 and plug 315 shown and described in relation to FIGS. 11A-D. The expander tool 425 is releasably connected to the inner diameter of the first tubular 450 preferably at its lower portion 450B and adjacent to the desired location for the first expandable packer portion 455. In an alternate embodiment, the expander tool 325 and working string 430 are not operatively connected to the first tubular 450.

The assembly including the expander tool 425 and the first tubular 450 may be lowered into the casing 417 to the desired location. Preferably, the desired location within the casing 417 is where the first tubular 450 is disposed above the zone of interest 445 so that the first tubular 450 may eventually provide a path for fluid, such as production fluid flowing from the zone of interest 445 or treatment fluid flowing into the zone of interest 445. In the alternate embodiment, the first tubular 450 is first lowered into the casing 417 to the desired location and set therein with a liner hanger or some other hanging mechanism, and the expander tool 425 is subsequently lowered into the first tubular 450 to a location adjacent to the first expandable packer portion 455.

After the assembly has arrived at its desired location within the casing 417, the first expandable packer portion 455 is deployed by expanding the first tubular 450 radially at the location of the first expandable packer portion 455. Expanding the first expandable packer portion 455 radially causes the outer diameter of the first expandable packer portion 455 to frictionally and sealingly engage the inner diameter of the casing 417, thereby anchoring the first tubular 450 within the wellbore 401 and providing a path for fluid flow through the first tubular 450 by preventing fluid from flowing through the annular area between the outer diameter of the first tubular 450 and the inner diameter of the casing 417.

The expander tool 425 is activated and operated as described above in relation to the expander tool 325 of FIG. 11A-D to expand the first tubular 450 past its elastic limit. The first expandable packer portion 455 is expanded so that its outer diameter is in gripping and sealing contact with the inner diameter of the casing 417, as shown in FIG. 12A.

After the first expandable packer portion 455 is expanded to anchor the first tubular 450 within the wellbore 401, the connection between the expander tool 425 and the inner diameter of the first tubular 450 may be released. (In the alternate embodiment where the expander tool 425 and the first tubular 450 are not connected, there is no connection to release.) The expander tool 425 may then be rotated and/or longitudinally translated to expand the circumference of the first tubular 450 and an extended length of the first tubular 450 if a larger packer is necessary. The expander tool 425 may be retrieved from the wellbore 401 by pulling up longitudinally on the working string 430.

FIG. 12B shows only the first expandable packer portion 455 expanded into the casing 417 and the expander tool 425 removed from the wellbore 401. At this time, wellbore operations may be performed within the wellbore 401 through the first tubular 450, such as operations involving obtaining fluid from the zone of interest 445 or treating the zone of interest 445 by one or more fluid treatments such as acidizing, fracturing, or testing. FIG. 12B shows the first tubular 450 acting as production tubing, as production fluid P is obtained from the zone of interest 445 and conveyed through the first tubular 450.

For any period of time desired, the wellbore production or treatment may continue with the first tubular 450 packing off the annulus and acting as the means for conveying fluid between the surface and the portion of the wellbore 401 below the first tubular 450. For example, production activities may be carried out or ceased for a period of years before the next step in the operation occurs.

The removal operation involves the expander tool 425. The expander tool 425 is next lowered into the wellbore 401 through the first tubular 450 by the working string 430 connected thereto to an eventual destination adjacent to a location within the first tubular 450 which remains unexpanded at the top of the first expandable packer portion 455. The expander tool 425 is activated and operated as described above in relation to the expander tool 325 of FIGS. 11A-D, thus extending the expander members 427 into contact with the inner diameter of the lower portion 450B of the first tubular 450 and rotating the expander tool 425 before, during, and/or after extension of the expander members 427. The first tubular 450 is expanded past its elastic limits into contact with the inner diameter of the casing 417 at the portion adjacent to the expander tool 425.

The expander tool 425 may then be translated longitudinally upward to expand an extended length of the first tubular 450. When the expander tool 425 reaches the first scribe 420 of the first tubular 450 or reaches a weakened location of the first tubular 450 near the scribe 420, the upper portion 450A of the first tubular 450 is sheared from the lower portion 450B of the first tubular 450. FIG. 12C shows the upper portion 450A of the first tubular 450 released from the lower portion 450B of the first tubular 450 by the radial stress imparted by the expander tool 425. The upper portion 450A of the first tubular 450 is then removed from the wellbore 401.

Next, the expander tool 425 may be translated further upward to expand the remaining unexpanded portion at the upper end of the lower portion 450B of the first tubular 450 to a larger inner diameter so that the lower portion 450B of the first tubular 450 may become a polished bore receptacle, or a template to receive subsequent tubulars and/or tools therein. Any type of tools and/or tubulars may be placed within the polished bore receptacle. If it is desired for the lower portion 450B of the first tubular 450 to act as a polished bore receptacle to receive and sealingly engage subsequent tubulars and/or tools therein, the first tubular 450 is machined and dimensioned prior to its insertion into the wellbore 401 to a known inner diameter calculated to engage the subsequent tubular and/or tool. The polished bore receptacle is sized and finished to provide a seal between the inner diameter of the polished bore receptacle and the outer surface of the tubular and/or tool.

FIG. 12D shows a second tubular 470 lowered into the lower portion 450B of the first tubular 450. Although the second tubular 470 shown in FIG. 12D includes a second scribe 475 and a second expandable packer portion 480 (see FIG. 12E), just as the first tubular 450 did, any type of tubular may be lowered into the first tubular 450 to provide a tubular path to the surface of the wellbore 401. The second tubular 470 is preferably placed at a location within the first tubular 450 calculated so that at the reduced length of the second tubular 470 upon expansion (described below), the second tubular 470 overlaps the first tubular 450 to provide a continuous fluid path through the first and second tubulars 450, 470. If it is desired that the first tubular 450 act as the polished bore receptacle, the second tubular 470 may include one or more sealing elements (e.g., one or more seals) (not shown) at a portion of its outer diameter which will reside within the inner diameter of the polished bore receptacle portion of the first tubular 450 to provide a sealing engagement between the polished bore receptacle and the second tubular 470.

Figure 12E:
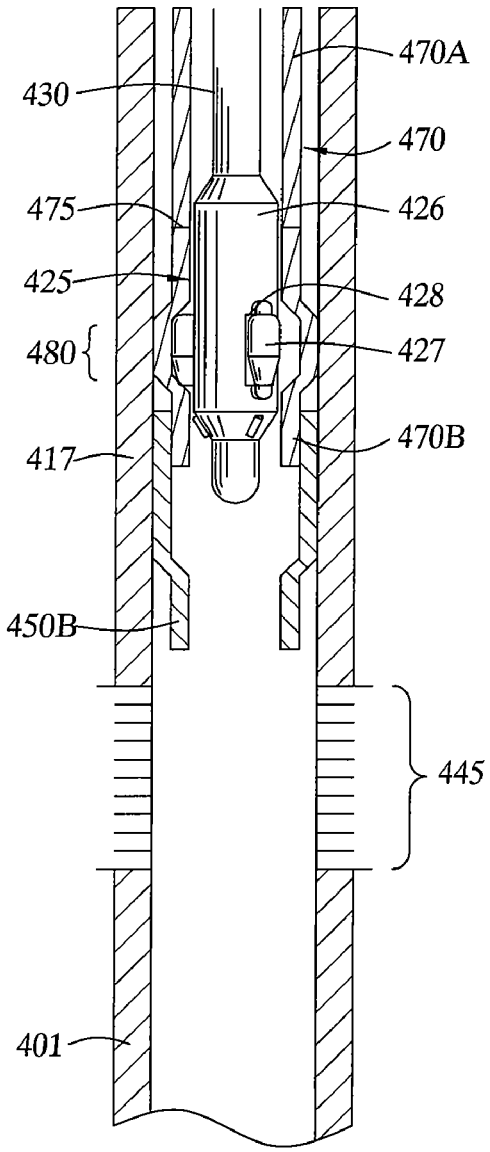

Next, if another integral tubular expandable packer is needed to supplement or replace the first integral tubular expandable packer, the expander tool 425 is lowered into the second tubular 470 to expand the second expandable packer portion 480 into the casing 417, as shown in FIG. 12E. The expander tool 425 expands the second expandable packer portion 480 in a substantially similar manner as it expanded the first expandable packer portion 455. FIG. 12E shows the second expandable packer portion 480 expanded within the wellbore 401 to frictionally and sealingly engage the inner diameter of the casing 417 above the first tubular 450. The expander tool 425 may be rotated and/or longitudinally translated to expand the circumference and an extended length of the second tubular 470.

The expander tool 425 may then be removed from the wellbore 401. Production or treatment operations may then again be performed on the zone of interest 445 or on any other region below the first and second tubulars 450 and 470 through the first and second tubulars 450 and 470 while the first expandable packer portion 455 and/or the second expandable packer portion 480 prevent fluid flow through the annulus between the inner diameter of the casing 417 and the outer diameter of the first and second tubulars 450 and 470. The expandable packer portions 455 and 480 may also act as anchors to retain the tubulars 450 and 470 at their position within the wellbore 401.

Figure 13A:
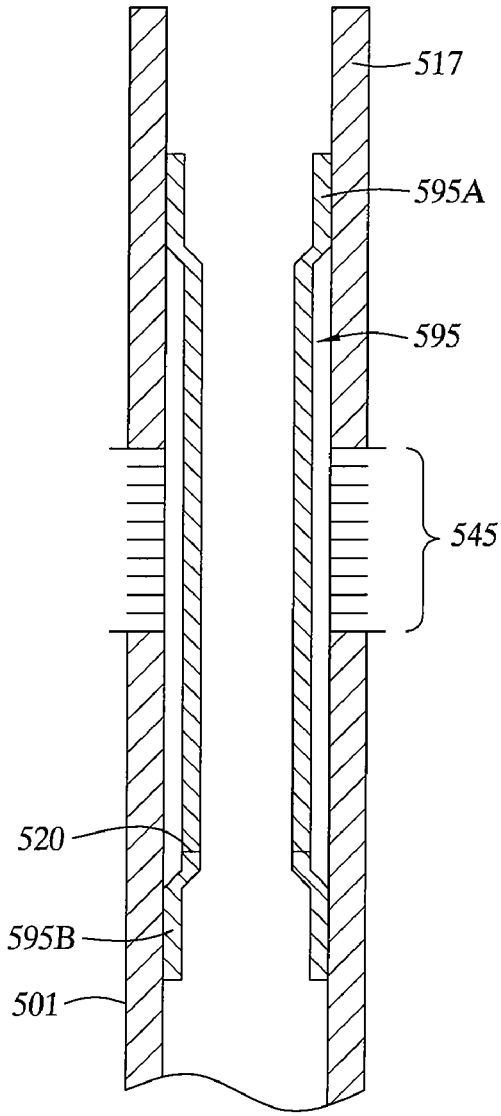
FIGS. 13A-E illustrate steps in a straddle installation and removal operation.

In another embodiment, a straddle installation and removal operation may be conducted utilizing expansion of a weakened tubular. FIGS. 13A-E illustrate a straddle removal operation. Referring initially to FIG. 13A, a first straddle 595 is initially located in a wellbore 501 within a formation. Casing 517 is located within the wellbore 501 and preferably set therein with cement. The first straddle 595 is a tubular body which is expanded at portions above and below a zone of interest 545 within the formation to isolate the zone of interest 545 for some purpose, such as to treat or access areas within the wellbore 501 other than the zone of interest 545. The expanded portions shown in FIG. 13A are an upper expanded portion 595A above the zone of interest 545 and the lower expanded portion 595B below the zone of interest 545.

The upper and lower expanded portions 595A, 595B are expanded into frictional and sealing contact with the inner diameter of the casing 517. The upper and lower expanded portions 595A, 595B may be expanded by any of the expander tools described above in relation to embodiments of FIGS. 11A-E and FIGS. 12A-E. The ends of the straddle 595 tubular are shown expanded, but any portion of the tubular may be expanded which provides a substantial seal around the zone of interest 545 with respect to the inner diameter of the straddle 595 tubing and the remainder of the wellbore 501, including expanding middle portions of the tubular without expanding the ends. A scribe 520 is disposed within a portion of the straddle 595 located below the zone of interest 545. The lower expanded portion 595B is preferably not initially expanded up to the scribe 520 or to a weakened portion of the straddle 595 proximate to the scribe 520 so that the straddle 595 does not sever upon setting the straddle 595 within the wellbore 501.

One or more sealing elements (not shown) may be located on the outer diameter of the upper and/or lower expanded portions 595A, 595B of the straddle 595 to seal the annulus between the outer diameter of the straddle 595 and the inner diameter of the casing 517 above and below the zone of interest 545. The one or more sealing elements may include coating the outer diameter of one or more portions of the straddle 595 with an elastomer, soft metal, or epoxy to anchor the straddle 595 against the casing 517 and to create a seal against the casing 517. In the alternative, the sealing arrangement shown and described in U.S. Pat. No. 6,425,444, which was above incorporated by reference, may be utilized to create a downhole seal between the outer diameter of the straddle 595 and the casing 517. The one or more sealing elements may also include one or more sealing rings 190, as shown and described in relation to FIG. 6 above. Additionally, one or more gripping elements, such as the at least one slip member 195 shown and described above in relation to FIGS. 1-10, may be included on the outer diameter of the upper and/or lower expanded portions 595A, 595B to grippingly engage the inner diameter of the casing 517.

Figure 13B:
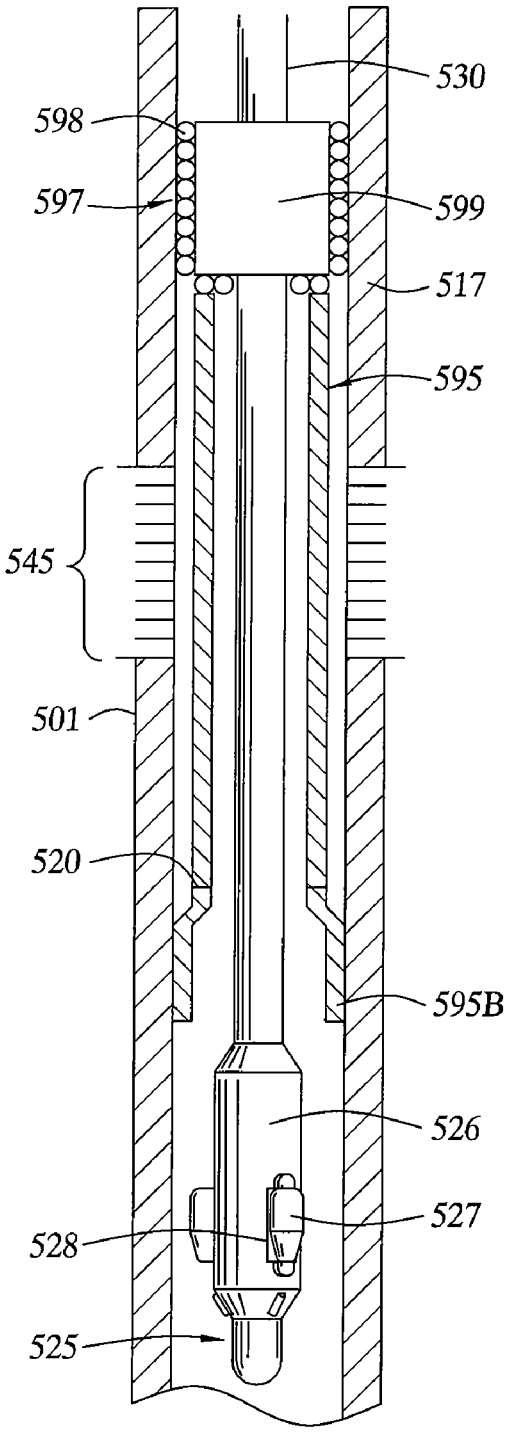

FIG. 13B shows a milling tool 597 disposed within the wellbore 501 to mill out a portion of the straddle 595. The milling tool 597 may be any milling tool capable of milling out or otherwise removing a portion of a tubular body known to those skilled in the art. In one embodiment, one or more aggressive chemicals may be utilized to remove a portion of the straddle 595 by dissolving the portion of the straddle 595. The milling tool 597 which is shown has a longitudinal bore therethrough and includes one or more cutting elements 598 located on a milling tool body 599 for milling through the desired portion of the straddle 595.

The milling tool 597 is located in a working string 530. The working string 530 is used to transport the milling tool 597 into the wellbore 501 from the surface, and may also serve as a fluid path to an expander tool 525 which is also located in the working string 530. The distance between the expander tool 525 and the milling tool 597 is preferably predetermined so that the expander tool 525 is locatable below the scribe 520 when the milling tool 597 is finished milling out the portion of the upper expanded portion 595A of the straddle 595 which is in sealing and in gripping engagement with the casing 517 (see description of the operation below). The expander tool 525 is substantially similar in structure and operation to the expander tools 325 and 425 shown and described in relation to FIGS. 13A-E.

In operation, the first straddle 595 is initially a generally tubular body having a substantially uniform inner diameter throughout. The first straddle 595 is lowered into the inner diameter of the casing 517 from the surface of the wellbore 501, for example by using a running tool (not shown), and positioned so that a portion of the first straddle 595 is disposed above the zone of interest 545 and a portion of the first straddle 595 is disposed below the zone of interest 545. After the first straddle 595 is adequately positioned for straddling the zone of interest 545, the upper expanded portion 595A and the lower expanded portion 595B are expanded past their elastic limits and into sealing and gripping contact with the casing 517 by any expander tool or expansion method shown and described above in relation to FIGS. 11A-E and FIGS. 12A-E. The expander tool 525 may be run into the wellbore 501 with the first straddle 595, or in the alternative, may be lowered into the wellbore 501 after the first straddle 595 has been appropriately positioned within the wellbore 501. FIG. 13A shows the first straddle 595 located in position to straddle the zone of interest 545 within the formation and the upper and lower expanded portions 595A, 595B expanded into frictional and sealing contact with the surrounding casing 517.

The above description only mentions one method of setting the first straddle 595 within the wellbore 501. Any other method known by those skilled in the art of setting a straddle around a zone of interest within a wellbore may be utilized in lieu of the setting method described above.

The desired operation is then conducted while the first straddle 595 isolates the zone of interest 545 from the remaining portions of the wellbore 501. After some time has passed, it may be appropriate to remove the first straddle 595 from its zone-isolating position for various reasons, including but not limited to damage to the first straddle 595 which may require replacement of the first straddle 595 due to lack of effectiveness of the seal against fluids entering the zone of interest 545, desire to access areas below the straddle 545 with tools which may be limited by the restricted inner diameter caused by the non-expanded portion of the straddle 595, or desire to access the zone of interest 545.

FIG. 13B shows the first step in removing the first straddle 595 from its sealing relationship with the casing 517 around the zone of interest 545. A working string 530 is assembled with the milling tool 597 located above the expander tool 525 in the working string 530. With the expander members 527 initially retracted, the working string 530 is lowered into the wellbore 501 within the first straddle 595. When the cutting elements 598 of the milling tool 597 contact the upper end of the first straddle 595, the milling tool 597 cuts through the upper expanded portion 595A of the first straddle 595, at least until the upper expanded portion 595A is no longer in a sealing and gripping relationship with the casing 517. In FIG. 13B, the milling tool 597 has milled through the upper expanded portion 595A of the straddle 595.

The milling tool 597 may be used to remove any length of the first straddle 595, but at least removes the length of the upper expanded portion 595A grippingly engaging the surrounding casing 517. Next, the working string 530 is manipulated to position the expander tool 525 adjacent to the upper end of the lower expanded portion 595B (adjacent to the unexpanded portion of the first straddle 595). The expander members 527 are activated as described above in relation to the expander tool 325 of FIG. 11A-D to contact the inner diameter of the first straddle 595 and expand the first straddle 595 therearound radially past its elastic limits. The expander tool 525 may then be translated upward using the working string 530 and rotated to expand an extended length of the first straddle 595 and the circumference of the first straddle 595. Whether or not upward translation of the working string 530 is necessary depends upon whether the initial expansion of the portion of the first straddle 595 therearound is sufficient to cause the first straddle 595 to sever into two tubular portions at or near the location of the first scribe 520.

Figure 13C:
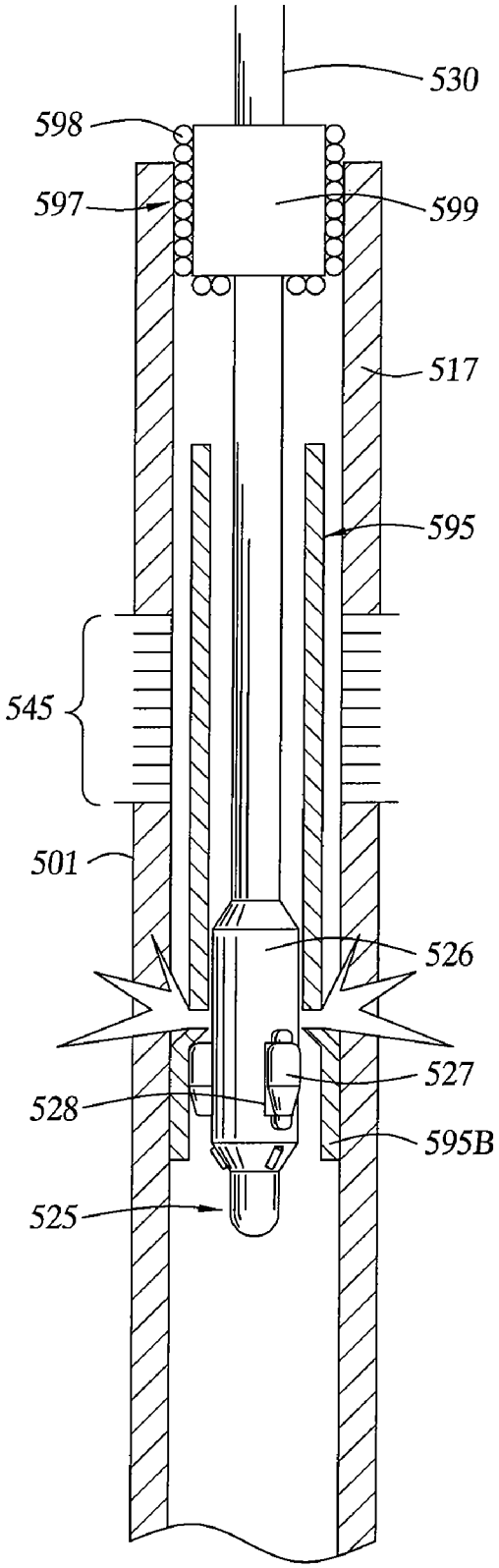
Figure 13D:
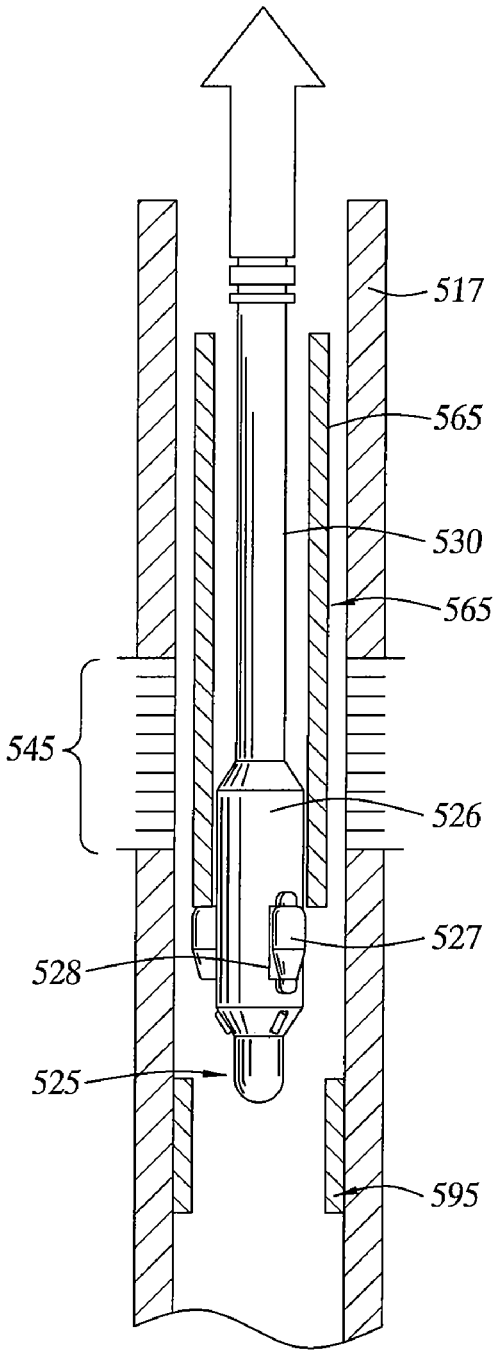

The expansion force causes the first straddle 595 to separate at or near the first scribe 520, as shown in FIG. 13C. After the severing of the first straddle 595, the expander tool 525 may be raised upward by the working string 530 to expand any remaining unexpanded portion of the lower severed end of the first straddle 595 which remains in gripping contact with the casing 517. The expander tool 525 may also simultaneously carry the upper severed portion of the first straddle 595 from the wellbore 501, as shown in FIG. 13D. Alternatively, the upper severed portion of the first straddle 595 may be retrieved in any other manner. FIG. 13D illustrates the straddle being retrieved from the wellbore 501 and the lower severed portion of the first straddle 595 expanded to a substantially uniform inner diameter, with the outer diameter of the lower severed portion of the first straddle 595 grippingly engaging the casing 517. Expanding the lower portion of the first straddle 595 to a uniform enlarged inner diameter provides the maximum amount of clearance for tools which may be subsequently lowered below the lower portion of the first straddle 595 and for conveying of fluids therethrough, as the lower portion of the first straddle 595 remains within the wellbore 501 at the end of the straddle removal operation as shown in FIG. 13D.

Figure 13E:
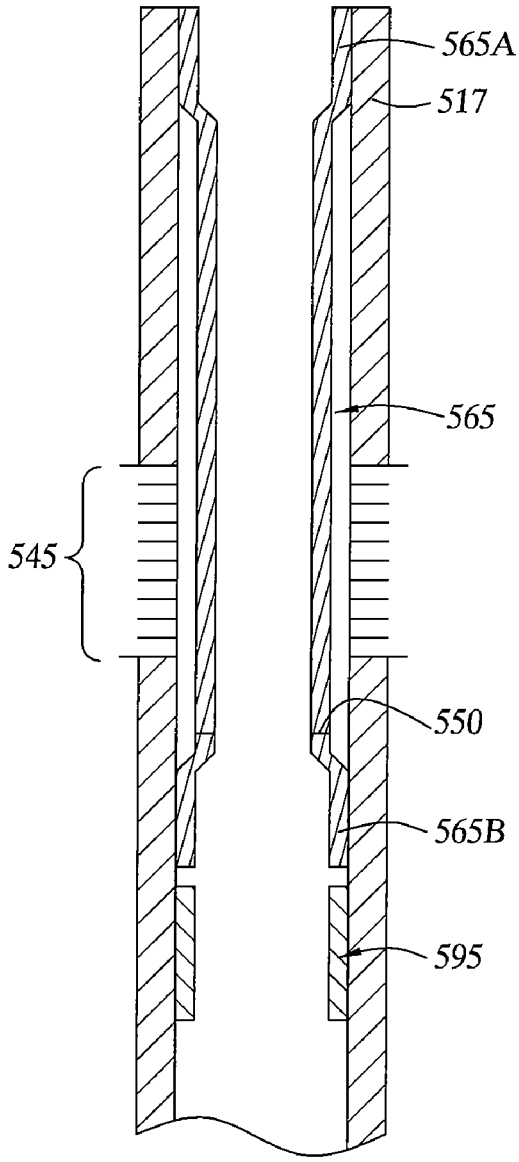

After the upper portion of the severed first straddle 595 is removed from the wellbore 501, the desired wellbore operation is conducted. The wellbore operation may include production of hydrocarbons from the zone of interest 545 which is now unobstructed, lowering of tools for wellbore operations below the zone of interest 545, treatment of the unobstructed zone of interest 545, and/or installment of a replacement second straddle 565 within the wellbore 501, the latter being shown in FIG. 13E. The second straddle 565 is conveyed into the wellbore 501, and the upper and lower expanded portions 565A and 565B are expanded into gripping and sealing contact with the casing 517 at positions above and below the zone of interest 545, respectively, as shown and described above in relation to the first straddle 595 or by any other straddle-setting method known to those skilled in the art. The operation then may continue as shown and described above in relation to the first straddle 595 of FIGS. 13A-D, and ultimately the second straddle 565 may be removed from the wellbore 501 by severing the second straddle 565 into two portions at or near a second scribe 550, as shown and described above in relation to FIGS. 13A-D. FIG. 13E shows the second straddle 565 straddling the zone of interest 545 within the formation, with the upper expanded portion 565A expanded into the casing 517 above the zone of interest 545 and the lower expanded portion 565B expanded into the casing 517 below the zone of interest 545.

Although not depicted in FIGS. 13A-D, an alternate embodiment of the present invention includes providing a scribe below the upper expanded portion 595A, preferably above the area of interest 545, in addition to the scribe 520 above the lower expanded portion 595B. In this embodiment, the upper expanded portion 595A does not have to be milled through to remove the portion of the first straddle 595 blocking access to the area of interest 545. The expander tool 525 may be utilized in this embodiment to separate the first straddle 595 at both scribes and allow removal from the wellbore 501, if desired, of the portion of the first straddle 595 which is broken from the remainder of the first straddle 595. An additional scribe may be provided in the second straddle 565 also.

In all of the above embodiments, the scribe is merely an exemplary type of weakened portion which may be formed within the tubular body. In lieu of or in addition to the scribe, other embodiments of the present invention may include other types of and methods of forming weakened portions within the tubular. For example, the weakened portion in the tubular may be as shown and described in U.S. Pat. No. 6,629,567, which is incorporated by reference herein.

The embodiments shown in relation to FIGS. 11A-F, FIGS. 12A-E, FIGS. 13A-E, FIGS. 14A-C, and FIGS. 15A-J were described by terms such as "upward" and "downward", as well as "above" and "below". However, embodiments of the present invention are not limited to these particular directions or to a vertical wellbore, but are merely terms which are used to describe relative positions within the wellbore. Namely, it is within the purview of the present invention that the embodiments described above may be applied to a lateral wellbore, horizontal wellbore, or any other directionally-drilled wellbore to describe relative positions of objects within the wellbore and relative movements of objects within the wellbore.

Additionally, the embodiments shown and described in relation to FIGS. 11A-F, FIGS. 12A-E, FIGS. 13A-E, FIGS. 14A-C, and FIGS. 15A-J may include the expander tool 120 shown and described above in relation to FIGS. 1-10 rather than the expander tools 325, 425, 525. Furthermore, the embodiments shown and described above may include any other type of expander tool known to those skilled in the art in lieu of the expander tools 325, 425, 525, including but not limited to a mechanical expandable cone energized downhole, internal pressure within the expandable tubular, or an inflation tool for inflating an elastomeric bladder inside the expandable tubular to expand the tubular.

Some of the above descriptions of FIGS. 11A-F, FIGS. 12A-E, FIGS. 13A-E, FIGS. 14A-C, and FIGS. 15A-J enumerate embodiments wherein the expander tools 325, 425, 525 are run into the wellbores 301, 401, 501 at the same time as the tubulars 315, 450, 470, 595, 565, while some of the above descriptions mention embodiments where the tubulars 315, 450, 470 are run into the wellbores 301, 401, 501, and then the expander tools 325, 425, 525 are run in separately thereafter. Either method is contemplated for use in any of the above embodiments. Additionally, the above descriptions of the embodiments shown in FIGS. 11A-F, FIGS. 12A-E, FIGS. 13A-E, FIGS. 14A-C, and FIGS. 15A-J are in the context of an operation conducted within a wellbore 301, 401, 501, but it is within the scope of further embodiments of the present invention that the same concepts involving severing a weakened portion of a tubular may be applied in other scenarios besides applications within a wellbore or besides oil field applications.

While the foregoing is directed to embodiments of the present invention, other and further embodiments of the invention may be devised without departing from the basic scope thereof. In this respect, it is within the scope of the present inventions to expand a tubular having a scribe into the formation itself, rather than into a separate string of casing. In this embodiment, the formation becomes the surrounding tubular. Thus, the present invention has applicability in an open hole environment.

The invention claimed is:

1. An expander tool for expanding a tubular, comprising:

a body having a longitudinal bore therein; and at least two expansion members radially extendable from the body into contact with a surrounding inside surface of the tubular, wherein the at least two expansion members are axially spaced and are radially extendable at different times.

2. The expander tool of claim 1, wherein the at least two expansion members expand the tubular at axially spaced locations.

3. The expander tool of claim 1, wherein one of the at least two expansion members expands the tubular at a first location before the other one of the at least two expansion members expands the tubular at a second location axially spaced from the first location.

4. The expander tool of claim 1, wherein the at least two expansion members expand a circumferential area of the tubular by rotation of the at least two expansion members.

5. The expander tool of claim 1, wherein the body is supported by a work string.

6. The expander tool of claim 5, wherein the longitudinal bore of the body is in fluid communication with the work string.

7. The expander tool of claim 1, wherein each of the at least two expansion members are in fluid communication with the longitudinal bore of the body.

8. The expander tool of claim 1, wherein the tubular is supported by the body of the expander tool.

9. The expander tool of claim 1, further comprising a plurality of dogs radially disposed about the body of the expander tool, wherein the plurality of dogs are adapted to engage an inside surface of the tubular to support the tubular.

10. The expander tool of claim 9, wherein the plurality of dogs are radially disposed about the body of the expander tool in a circumferential profile.

11. The expander tool of claim 9, further comprising a swivel, wherein the swivel allows a portion of the body of the expander tool to rotate while the plurality of dogs remain stationary.

12. The expander tool of claim 1, wherein each of the at least two expansion members comprise:

a roller;

a radially movable piston coupled to the roller, wherein the piston is in fluid communication with the longitudinal bore; and a connection member, wherein the connection member temporarily prevents radial movement of the piston.

13. The expander tool of claim 12, wherein the connection member of one of the at least two expansion members prevents radial movement of the piston longer than the connection member of the other one of the at least two expansion members.

14. The expander tool of claim 12, wherein the connection member is a shearable pin.

15. The expander tool of claim 1, wherein the at least two expansion members are spirally disposed about the body.

16. A method of expanding a tubular, comprising:

providing an expander tool within the tubular, the expander tool comprising at least two expansion members radially extendable from a body having a longitudinal bore therethrough;

radially extending one of the at least two expansion members into contact with an inside surface of the tubular to expand a first area of the tubular; and thereafter radially extending the other one of the at least two expansion members into contact with the inside surface of the tubular to expand a second area of the tubular, wherein the first and second areas are axially spaced from one another.

17. The method of claim 16, wherein the at least two expansion members radially extend in response to pressurized fluid within the longitudinal bore.

18. The method of claim 16, further comprising providing a first fluid pressure to extend one of the at least two expansion members, and providing a second fluid pressure to extend the other one of the at least two expansion members, wherein the second fluid pressure is greater than the first fluid pressure.

19. The method of claim 16, further comprising rotating the at least two expansion members to form an expanded circumferential area of the tubular.

20. The method of claim 19, further comprising supporting the tubular with the body of the expander tool while rotating the at least two expansion members.

21. A method of expanding a tubular, comprising:

running an expansion assembly that is supporting a tubular into a wellbore;

actuating the expansion assembly to expand a first portion of the tubular while preventing expansion of a second portion of the tubular; and actuating the expansion assembly to expand the second portion of the tubular, thereby severing the second portion of the tubular from the first portion of the tubular.

22. The method of claim 21, further comprising rotating the expansion assembly to circumferentially expand the first portion of the tubular.

23. The method of claim 22, further comprising rotating the expansion assembly to circumferentially expand the second portion of the tubular.

24. The method of claim 23, further comprising preventing rotation of the tubular relative to the wellbore when rotating the expansion assembly.

25. The method of claim 24, further comprising removing the second portion of the tubular and the expansion assembly from the wellbore.

26. The method of claim 21, wherein actuating the expansion assembly to expand the second portion of the tubular includes shearing a shearable member of the expansion assembly.

27. The method of claim 26, wherein the expansion assembly includes a first radially extendable member configured to expand the first portion of the tubular and a second radially extendable member configured to expand the second portion of the tubular.

28. The method of claim 27, further comprising preventing the second radially extendable member from expanding the second portion of the tubular with the shearable member while expanding the first portion of the tubular with the first radially extendable member.

29. The method of claim 28, further comprising shearing the shearable member with the second radially extendable member and expanding the second portion of the tubular with the second radially extendable member.

30. A method of expanding a tubular, comprising:

running a tubular that is supported by an expansion assembly having a first member and a second member into a wellbore;

actuating the first member to expand a first portion of the tubular while preventing actuation of the second member; and actuating the second member to expand a second portion of the tubular.

31. The method of claim 30, further comprising severing the second portion of the tubular from the first portion of the tubular during expansion of the second portion of the tubular.

32. The method of claim 30, further comprising rotating the expansion assembly to circumferentially expand the first and second portions of the tubular.

33. The method of claim 30, wherein preventing actuation of the second member includes preventing extension of the second member with a shearable member while expanding the first portion of the tubular with the first member.

34. The method of claim 33, wherein actuating the second member to expand the second portion of the tubular includes shearing the shearable member using the second member.

35. An apparatus for expanding a tubular, comprising:

a body having a bore disposed through the body;

a first member that is radially extendable from the body; and a second member that is radially extendable from the body and is configured to extend from the body after extension of the first member.

36. The apparatus of claim 35, wherein the second member is located above the first member.

37. The apparatus of claim 36, wherein the first and second members are in fluid communication with the bore.

38. The apparatus of claim 37, further comprising a shearable member coupled to the body and configured to temporarily prevent extension of the second member while the first member is extended.

39. The apparatus of claim 38, wherein the first and second members include rollers.

40. The apparatus of claim 39, wherein the first and second members are longitudinally offset.

* * * * *